US005887471A

United States Patent [19]

Itaya

[11] Patent Number: 5,887,471

[45] **Date of Patent: *Mar. 30, 1999**

[54] SPRING MANUFACTURING APPARATUS AND MANUFACTURING METHOD OF THE SAME

[75] Inventor: Ichiro Itaya, Tokyo, Japan

[73] Assignee: Kabushiki Kaisha Itaya Seisaku Sho, Tokyo, Japan

[ * ] Notice: The term of this patent shall not extend beyond the expiration date of Pat. No. 5,839,312.

[21] Appl. No.: 862,681

[22] Filed: May 23, 1997

Related U.S. Application Data

[63] Continuation of Ser. No. 766,933, Dec. 16, 1996, abandoned, which is a continuation of Ser. No. 365,890, Dec. 29, 1994, abandoned.

[30] Foreign Application Priority Data

Jun. 30, 1994 [JP] Japan ..... 6-149143

[51] Int. Cl.[6] ..... B21F 3/04; B21F 3/02

[52] U.S. Cl. ..... 72/142; 72/142; 72/140; 72/135

[58] Field of Search ..... 72/135, 137, 138, 72/140, 142, 145, 307, 428, 442, 452

[56] References Cited

U.S. PATENT DOCUMENTS

| | | | |
|---|---|---|---|
| 4,825,678 | 5/1989 | Post | 72/307 |
| 4,934,165 | 6/1990 | Philpot et al. | 72/138 |
| 5,259,226 | 11/1993 | Itaya | 72/138 |
| 5,285,669 | 2/1994 | Itaya | 72/132 |
| 5,363,681 | 11/1994 | Speck et al. | 72/137 |
| 5,452,598 | 9/1995 | Cheng | 72/137 |

FOREIGN PATENT DOCUMENTS

| | | |
|---|---|---|
| 37 12 110 | 4/1988 | Germany . |
| 41 32 317 C1 | 8/1992 | Germany . |
| 1254927 | 10/1995 | Italy . |
| 1254928 | 10/1995 | Italy . |
| 1254929 | 10/1995 | Italy . |
| 52-40633 | 10/1977 | Japan . |
| 54-15032 | 1/1979 | Japan . |
| 54-52661 | 4/1979 | Japan . |
| 54-52662 | 4/1979 | Japan . |
| 59-144542 | 8/1984 | Japan . |
| 61-190326 | 11/1986 | Japan . |
| 62-148045 A | 7/1987 | Japan . |

OTHER PUBLICATIONS

"Dictionary of Metal Material Technical Term With Explanatory Diagram", by Nikkan Kogyo Shinbun Sha, Nov. 20, 1988.

Handbuch Fedrn, Verlag Technik Berlin, 1988, pp. 60–61, Fig. 3.2.

*Primary Examiner*—Joseph J. Hail, III
*Assistant Examiner*—Rodna Butler
*Attorney, Agent, or Firm*—Merchant, Gould, Smith, Edell, Welter & Schmidt

[57] ABSTRACT

A spring manufacturing apparatus in which the conventional cumbersome process of forming the front end of a quill in accordance with the shape of a desired spring is omitted, and one quill can be used in common for formation of springs having any shapes. A wire is fed out from a wire guide constituted by right and left members, two members symmetric with each other and having inclined surfaces. Tools that are radially arranged to be slidable toward a spring forming space and used for bending, curving, or cutting the wire are caused to abut against the wire to bend or curve it, thereby forming a spring. The spring manufacturing apparatus includes a rotary guide unit, a guide driving motor, tool driving motors, and a CPU. The rotary wire guide unit supports the wire guide and is rotatable about a wire feedout hole of the guide as the center. The guide driving motor transmits a driving force to the rotary wire guide unit. The tool driving motors slide the tools. The CPU controls the guide driving motor and the tool driving motors at predetermined timings. The CPU changes the position of the spring forming space near the front end of the guide by the guide driving motor in accordance with the shape of the spring.

6 Claims, 31 Drawing Sheets

SPRING MANUFACTURING APPARATUS AND MANUFACTURING METHOD OF THE SAME

This is a Continuation of application Ser. No. 08/766,933, filed Dec. 16, 1996, now abandoned, which is a Continuation of application Ser. No. 08/365,890, filed Dec. 29, 1994, abandoned.

BACKGROUND OF THE INVENTION

1. Field of the Invention

The present invention relates to a spring manufacturing apparatus and a manufacturing method of the same and, more particularly, to a spring manufacturing apparatus for manufacturing a compression coil spring, a tension coil spring, a torsion coil spring, and the like, and a manufacturing method of the same.

2. Description of the Related Art

A conventional spring manufacturing apparatus requires a tool called a quill for guiding a wire, which is to be formed into a spring, to a predetermined position. This quill is constituted by a liner portion having a hole through which a wire is guided from a wire supply position to a spring forming position, and a wire guide for feeding out the wire from the front end of the liner and the fed wire is formed to a desired spring shape by using a tool used for bending, curving, or cutting.

A conventional spring manufacturing apparatus using a quill of this type, for example, one disclosed in Japanese Patent Laid-Open No. 54-52662 is known. In this apparatus, a support is mounted on an outer portion of a wire guide. The support is set to be rotatable about the hole of the wire guide as the center. The support is rotated in an interlocked manner with the projecting and retracting movements of a tool, which is used for bending, curving, or cutting the wire and projects and retracts toward and from the front end of the wire guide, so that the tool will not collide against the support. Therefore, the completed coil spring will not have a linear portion at its starting distal end, a sharply bent portion at its trailing distal end, and the like.

Also, another conventional spring manufacturing apparatus disclosed in Japanese Patent Laid-Open No. 54-52661 is known. According to this disclosure, a tool stop is mounted to a support which is rotatable with respect to a wire guide. This support is rotated in an interlocked manner with the projecting and retracting movements of the tool, so that the tool will not collide against the support. Therefore, the rate of non-defective articles is increased, and variations in the articles are suppressed.

However, in the conventional apparatuses having the above arrangements, the quill serving as a wire guide has a liner portion and a guide portion that are combined with each other. Since the liner portion requires a certain degree of length to guide the wire, the size of the quill itself is increased, and the size of the entire apparatus including the support is increased.

When an apparatus is constituted to have a rotatable quill, the larger the liner length, the higher the torsion stress applied by rotation of the quill to the wire inserted in the liner portion. Then, adverse effects, e.g., variations, occur in the completed articles due to the torsion stress.

The front end of a guide portions of the conventional quills have different shapes depending on desired spring shapes. If, e.g., many types of springs are to be manufactured, the quill must be exchanged by the operator, a very cumbersome operation, and the user must prepare quills having various shapes of the front end in stock. This leads to an increase in manufacturing cost.

In the conventional quill, when the wire is stuck in the liner portion, the stuck wire cannot be removed and thus the quill cannot be re-used.

SUMMARY OF THE INVENTION

The present invention has been in view of the above situations, and has as its object to provide a spring manufacturing apparatus in which a guide for feeding out the wire is rotatable, an operation of exchanging a quill, the front end of which has been formed in accordance with the shape of the desired spring, every time the type of the spring is altered, is unnecessary unlike when using the conventional quill, and the cost for stocking quills having various shapes is decreased, so that one quill can be used in common for formation of springs having any shapes, and the manufacturing method of the same.

In order to solve the above problems and to achieve the above object, according to the present invention, there is provided a spring manufacturing apparatus for feeding out a wire, which is to form a spring, from a front end of a wire guide, and causing tools, which are radially arranged to be slidable toward a spring forming space near the front end of the wire guide and used for bending, curving, or cutting the wire, to abut against the wire, in order to forcibly bend or curve the wire to form a coil, thereby manufacturing a spring, comprising rotating means for supporting the wire guide and rotating the guide about a wire feedout hole of the guide as the center, first driving means for transmitting a driving force to the rotating means, second driving means for sliding the tools for bending, curving, or cutting the wire, and control means for controlling the first and second driving means at predetermined timings, wherein the control means changes a position of the spring forming space near the front end of the guide by the rotating means in accordance with a shape of the spring.

Preferably, according to the present invention, there is also provided a spring manufacturing method of feeding out a wire, which is to form a spring, from a front end of a wire guide, and causing tools, which are radially arranged to be slidable toward a spring forming space near the front end of the wire guide and used for bending, curving, or cutting the wire, to abut against the wire, in order to forcibly bend or curve the wire to form a coil thereby manufacturing a spring, comprising the step of setting a position of the spring forming space near the front end of the wire guide, the step of sliding the tools, used for curving or bending the wire, so as to abut against the wire fed out from the wire guide, and forming the wire to have a desired shape, the step of detecting whether or not a coil portion of the wire is formed to have the desired shape, the step of rotating, when the coil portion of the wire is formed to have the desired shape, the wire guide by a predetermined angle about a wire feedout hole of the guide as the center, thereby changing the position of the spring forming space, the step of sliding the tools, used for curving or bending the wire, so as to abut against the wire fed out from the wire guide, and forming the wire to have a desired shape, and the step of sliding the tool used for cutting the wire, thereby cutting the wire formed to have the desired spring shape.

Other objects and advantages besides those discussed above shall be apparent to those skilled in the art from the description of a preferred embodiment of the invention which follows. In the description, reference is made to accompanying drawings, which form a part thereof, and which illustrate an example of the invention. Such example, however, is not exhaustive of the various embodiments of the invention, and therefore reference is made to the claims which follow the description for determining the scope of the invention.

DETAILED DESCRIPTION OF THE PREFERRED EMBODIMENT

The preferred embodiment of the present invention will be described in detail with reference to the accompanying drawings.

Overall Arrangement of Spring Manufacturing Apparatus

The overall arrangement of a spring manufacturing apparatus will be described.

Figure 1:
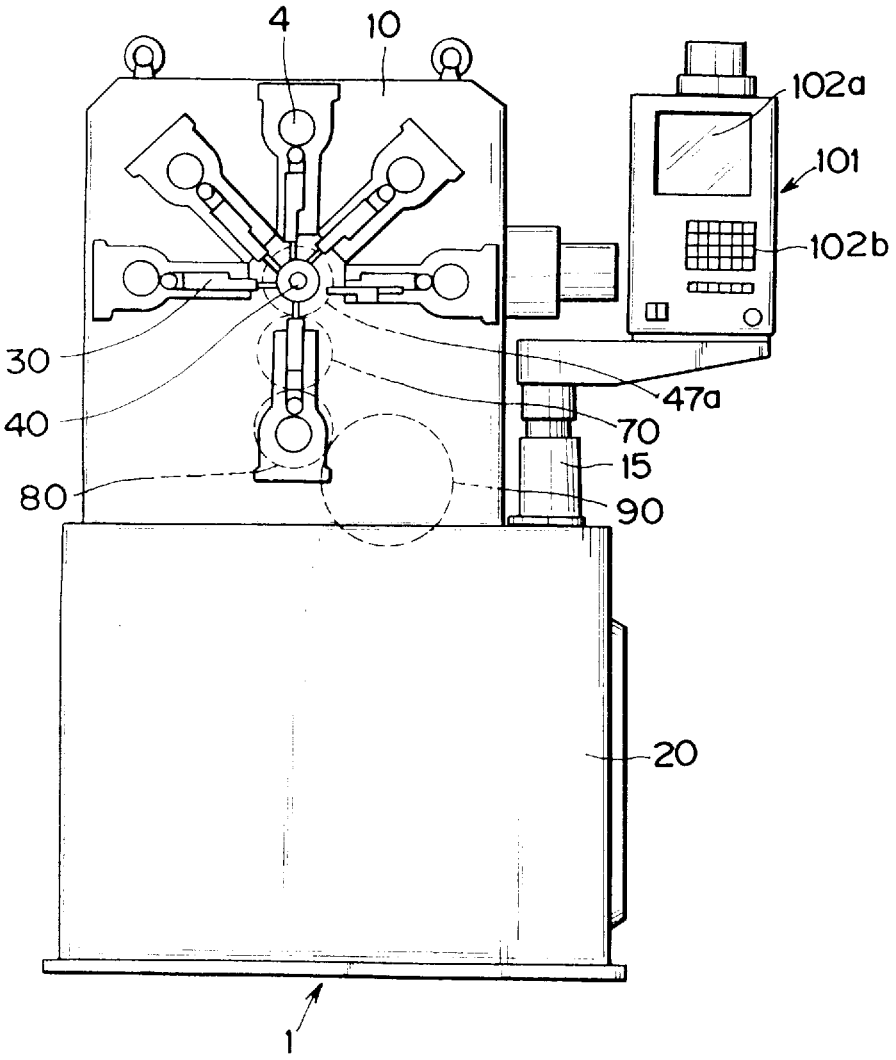
FIG. 1 is a front view showing the outer appearance of a spring manufacturing apparatus according to an embodiment of the present invention.
Figure 2:
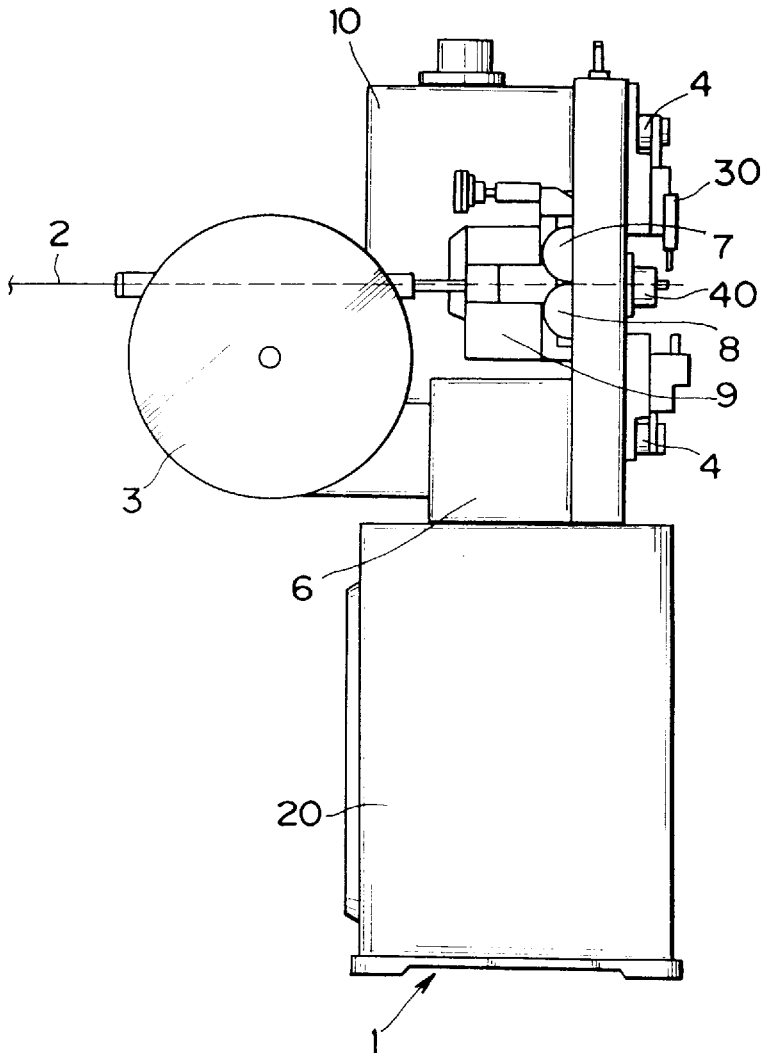
FIG. 2 is a side view of the spring manufacturing apparatus shown in FIG. 1.

FIG. 1 is a front view showing the outer appearance of a spring manufacturing apparatus according to an embodiment of the present invention, and FIG. 2 is a side view of the spring manufacturing apparatus shown in FIG. 1. Referring to FIGS. 1 and 2, a spring manufacturing apparatus 1 is obtained by fixing a base 10 and an operation unit support arm 15 on a table 20 to constitute an integral structure. The base 10 has a rotary wire guide unit 40 and a group of various types of tools 30 for forming a wire 2 into a spring. The group of tools 30 on the base 10 comprise a large number of tools radially provided about the wire feedout hole of the rotary wire guide unit 40 as the center. Various types of tools 30 are prepared, e.g., a wire bending tool, a wire curving tool, and a wire cutting tool, in accordance with the applications. The mounting positions of the tools 30 are set in accordance with the diameter of the wire and the shape of the spring. Eccentric cams 4 are provided at distal end portions of the respective types of tools 30 on a side opposite to the guide unit 40, such that they abut against the tools 30. The cams 4 are rotated upon reception of a driving force transmitted from tool driving motors (not shown) and gears (not shown) provided to the base 10. The respective tools 30 are mounted such that they can be slid by the corresponding cams toward the center of the rotary wire guide unit 40. More specifically, the respective tools 30 are moved for a predetermined period of time or to a predetermined position at preset speeds and a preset order based on the shapes and phase differences of the respective cams and stopped at that point. The tools 30 slide such that they will not collide with each other.

A guide gear 47*a* is axially supported by the rotary wire guide unit 40 to have the same rotating shaft. A driving force is transmitted to the guide gear 47*a* through a motor gear 90 axially mounted on a guide driving motor 6 provided under the base 10, and idle gears 70 and 80 set to have predetermined gear ratios. The guide gear 47*a* is rotated at a predetermined timing in an interlocked manner with the movements of the tools 30.

As shown in FIG. 2, the wire 2 is supplied from a feed roll 3 provided behind the base 10. The wire 2 is conveyed as it is pressed from above and below with feed rollers 7 and 8, and is inserted into the rotary wire guide unit 40. The feed rollers 7 and 8 are provided in the rear portion of the base 10 to clamp the wire 2. The feed rollers 7 and 8 are rotated at a predetermined timing by a roller driving unit 9 comprising a motor and a gear, and convey the wire 2.

An operation unit 101 is supported by the operation unit support arm 15 provided to the table 20, and the operator operates a display 102*a* and an input section 102*b* provided to the operation unit 101. The type, size (the diameter, the length, and the like), number, and the like of the springs to be manufactured are set at the operation unit 101.

The schematic arrangement of the spring manufacturing apparatus 1 of this embodiment has been described so far with reference to FIGS. 1 and 2.

Rotation of Rotary Wire Guide Unit

A method of rotating the rotary wire guide unit 40 described with reference to FIGS. 1 and 2 will be described.

Figure 3:
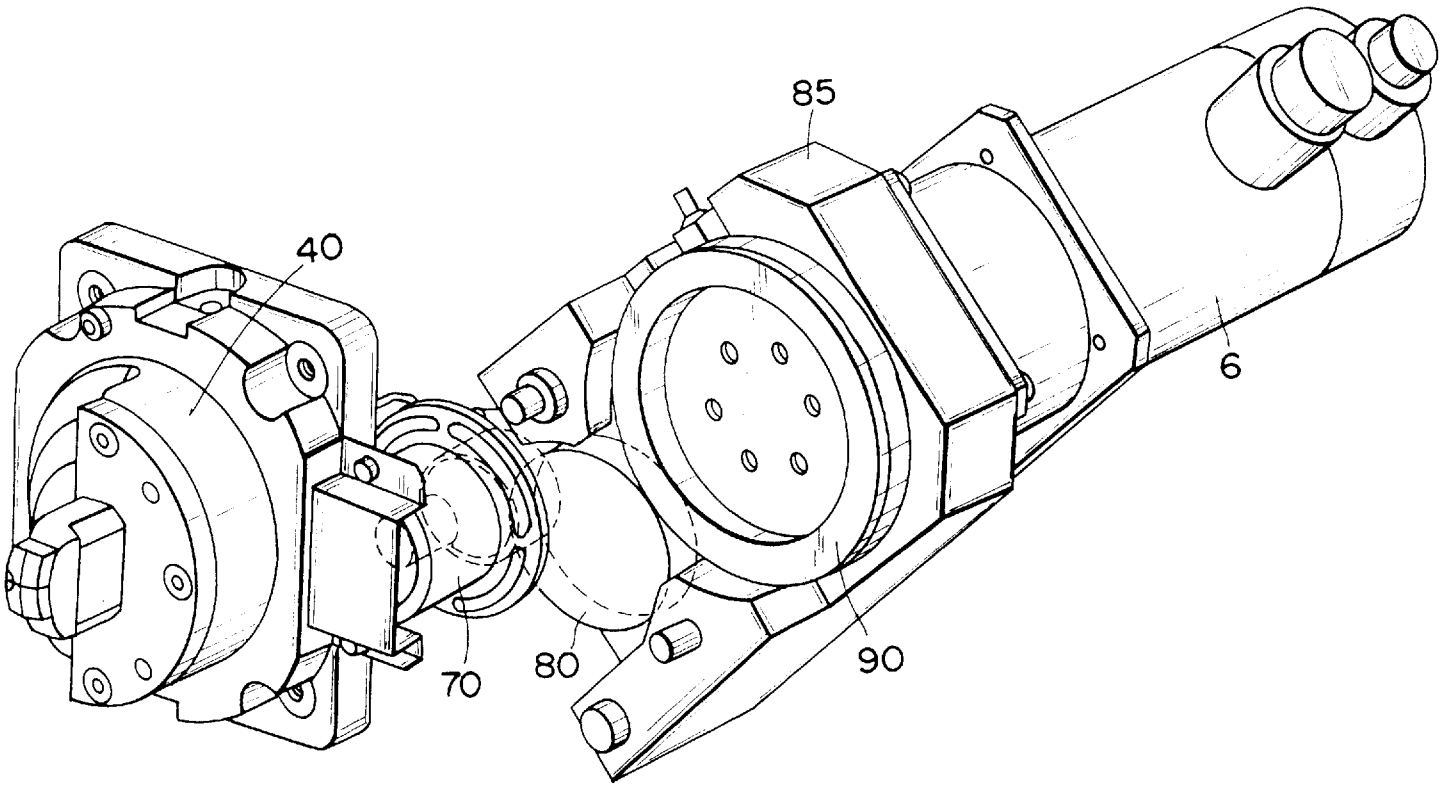
FIG. 3 is an outer appearance perspective view showing the driving force transmitting system of a rotary wire guide unit of this embodiment.
Figure 4:
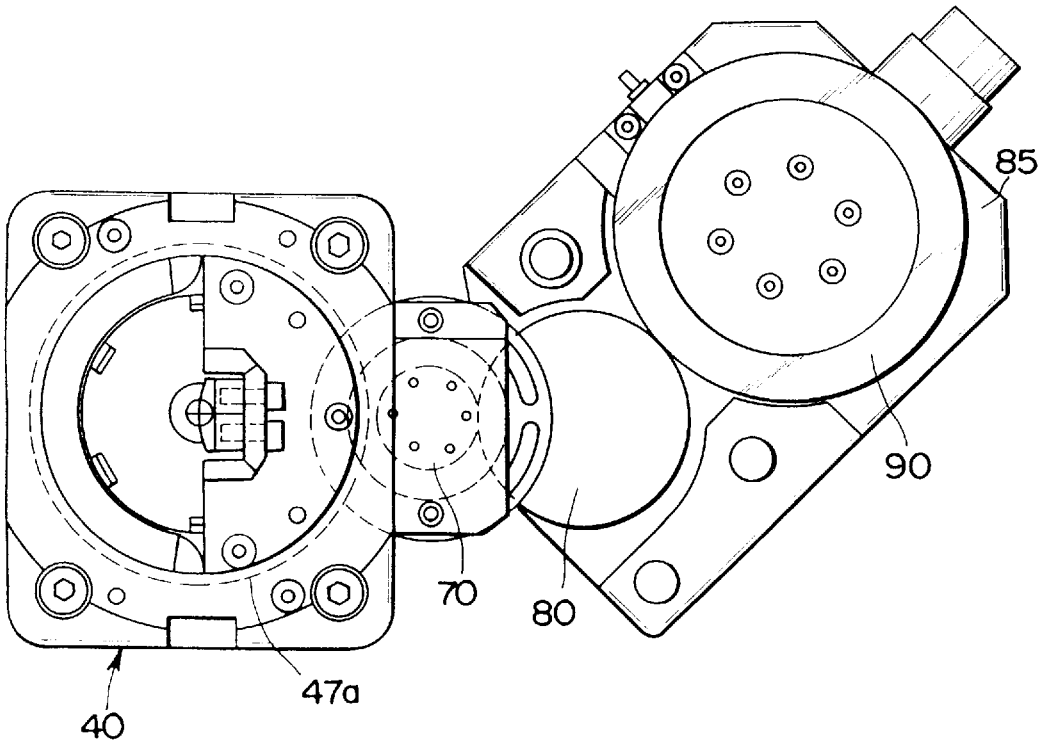
FIG. 4 is a front view of the system shown in FIG. 3.

FIG. 3 is an outer appearance perspective view showing the driving force transmitting mechanism of the rotary wire guide unit of this embodiment, and FIG. 4 is a front view of the system shown in FIG. 3. Referring to FIGS. 3 and 4, as the guide driving motor 6 rotates, a driving force is output from the motor gear 90 axially mounted on the motor 6 to have the same rotating shaft, and is transmitted to the idle gear 80 meshing with the motor gear 90. The idle gear 80 meshes with another idle gear 70, and the idle gear 70 transmits the driving force from the motor 6 to a rotatable gear 47*a* of the rotary wire guide unit 40. Both the motor gear 90 and the idle gear 80 are axially supported by a gear shaft support member 85, and the idle gears 70 and 80 are set to have predetermined gear ratios. As described with reference to FIGS. 1 and 2, the guide driving motor 6 is controlled to rotate the rotary wire guide unit 40 in an interlocked manner with the movements of the respective tools 30.

Arrangement of Rotary Wire Guide Unit

The arrangement of the rotary wire guide unit 40 described with reference to FIGS. 1 and 2 will be described in detail.

Figure 5:
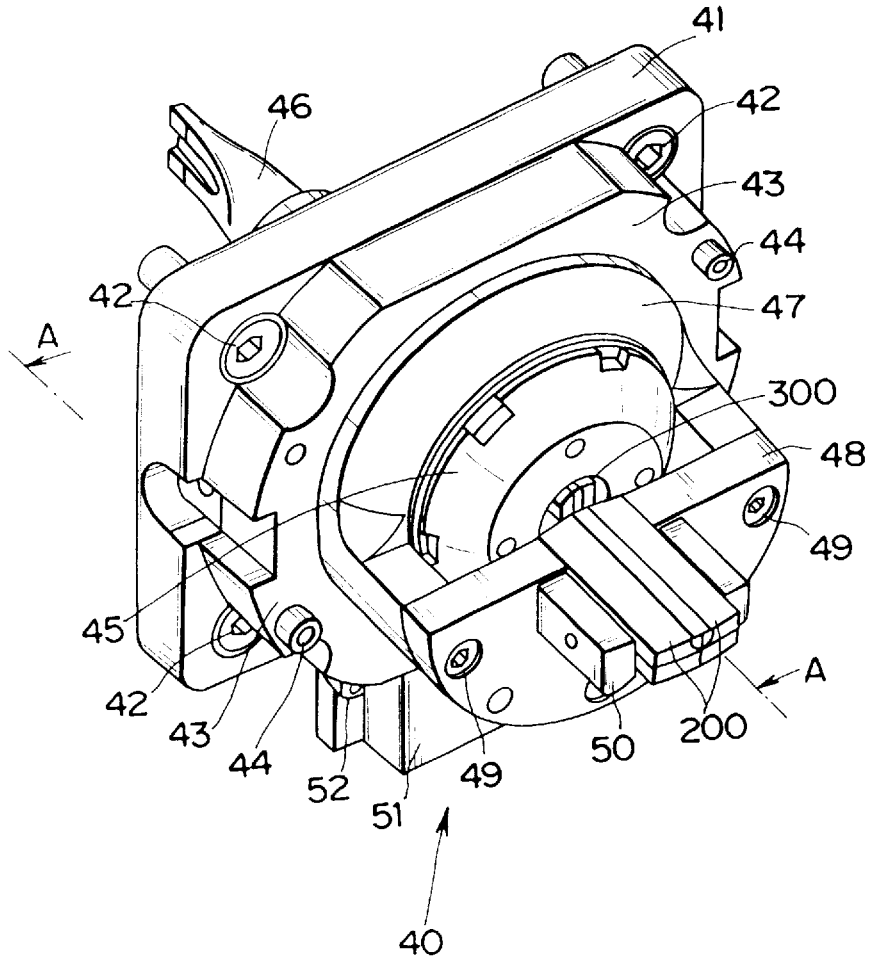
FIG. 5 is an outer appearance perspective view showing the overall arrangement of the rotary wire guide unit of this embodiment.
Figure 6:
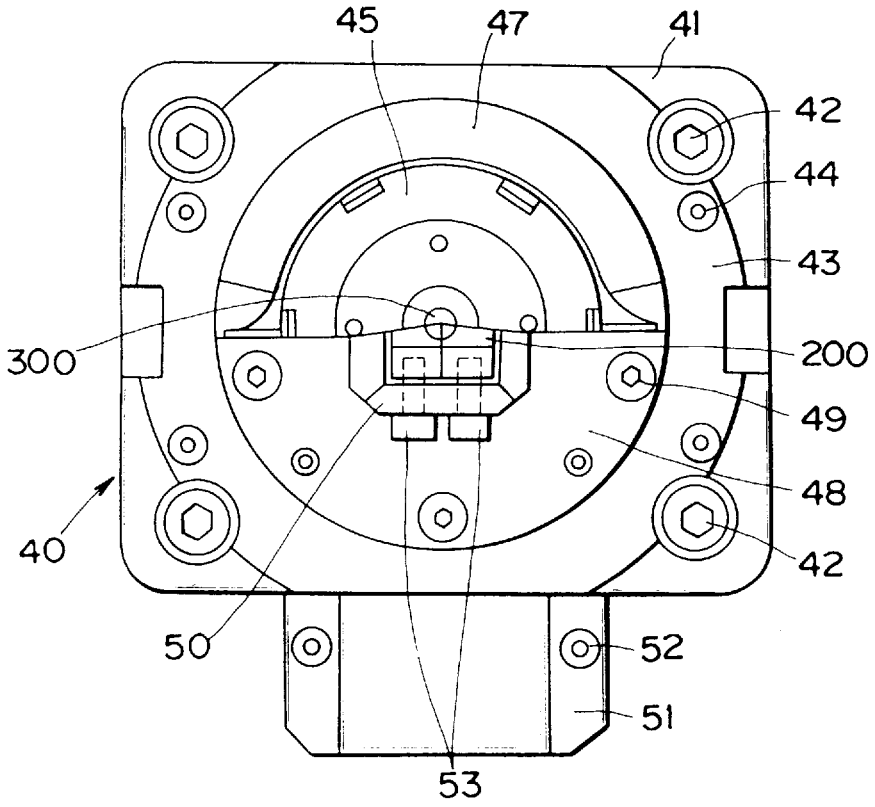
FIG. 6 is a front view of FIG. 5.
Figure 7:
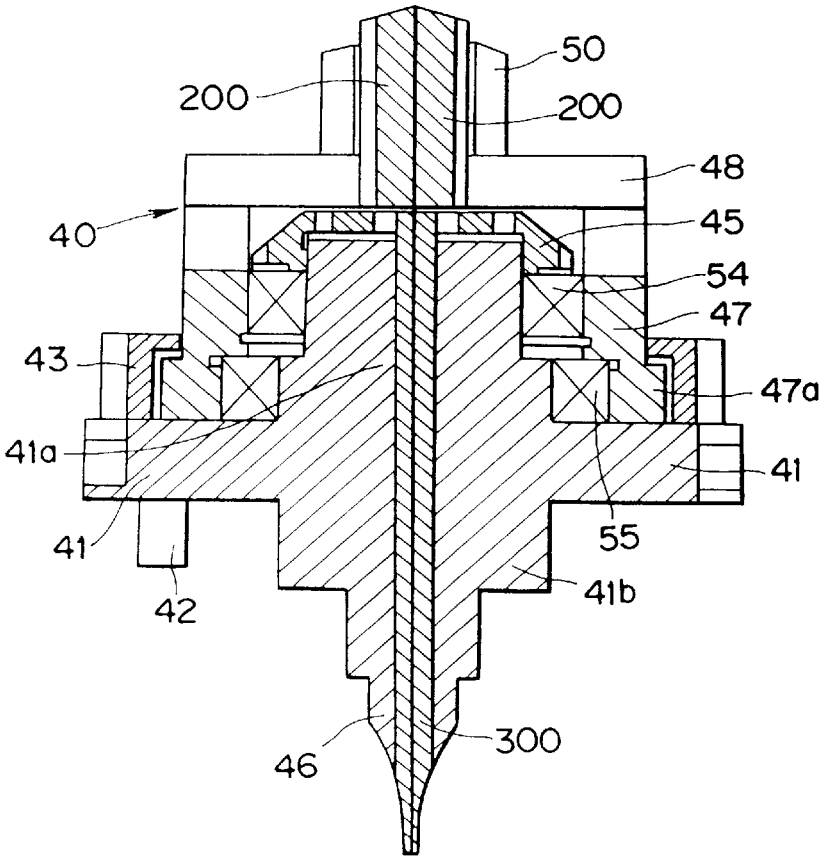
FIG. 7 is a sectional view taken along the line of arrows A—A of FIG. 5.

FIG. 5 is an outer appearance perspective view showing the overall arrangement of the rotary wire guide unit of this embodiment. FIG. 6 is a front view of FIG. 5. FIG. 7 is a sectional view taken along the line of arrows A—A of FIG. 5. Referring to FIGS. 5 to 7, the rotary wire guide unit 40 has a base portion 41, a cover portion 43, and a rotatable portion 47. As shown in FIG. 5, the base portion 41 is fixed to the base 10 shown in FIGS. 1 and 2 at four portions with mounting bolts 42. As shown in the sectional view of FIG. 7, the base portion 41 has projecting portions 41a and 41*b* cylindrically projecting from the two surfaces of a substantially square flange. A liner hole for receiving a liner 300 is formed to extend almost through substantially the central portion in the base portion 41. The liner 300 is used for feeding out the wire 2, conveyed from the feed rollers 7 and 8 shown in FIGS. 1 and 2, to a guide 200. A distal end portion 46 of the cylindrical projecting portion 41*b* is gradually tapered toward the front end so that it matches the diameter of the feed rollers 7 and 8. Furthermore, a disk member 45 is mounted to the other front end of the cylindrical projecting portion 41*a*.

The cover portion 43 has a central opening matching the outer shape of the rotatable portion 47 so that it externally protects a guide gear 47*a* provided to the rotatable portion 47 (to be described later), and is fixed to the base portion 41 with mounting bolts 44.

A cover 51 for protecting the idle gear 70 that transmits the driving force to the rotatable portion 47 is fixed to the lower portion of the base portion 41 at two portions with bolts 52.

The rotatable portion 47 has the shape of a cylinder having two open ends. The guide gear 47*a* for rotating the guide 200 is formed on the outer edge portion of one open end of the rotatable portion 47, and a semicircular plate member 48 for fixing the guide 200 is fixed to the other open end of the rotatable portion 47 with bolts 49. The rotatable portion 47 is partially cut out from its other end to halfway along the axial direction. As this rotatable portion 47 is fitted in the cylindrical projecting portion 41*b* of the base portion 41 from one open end through bearings 54 and 55, the rotatable portion 47 becomes rotatable. The bearings 54 and 55 are both radial bearings. When the two bearings are combined in this manner, they also serve as thrust bearings to a certain degree in the thrust direction.

A recessed projecting portion 50 is formed on the plate member 48 to project in the feedout direction of the wire 2. The guide 200 is mounted in this recessed portion as it is positioned with positioning pins 53.

Shape of Guide

Figure 8:
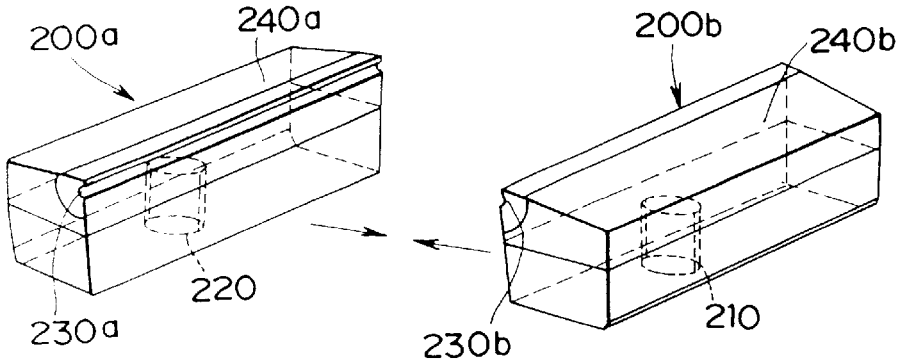
FIG. 8 is a perspective exploded view of the guides of this embodiment.
Figure 9:
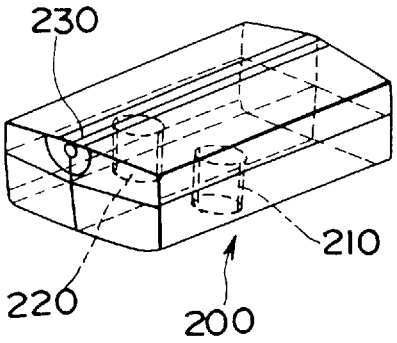
FIG. 9 is a perspective view showing a state wherein the respective guides shown in FIG. 8 are assembled together.
Figure 10:
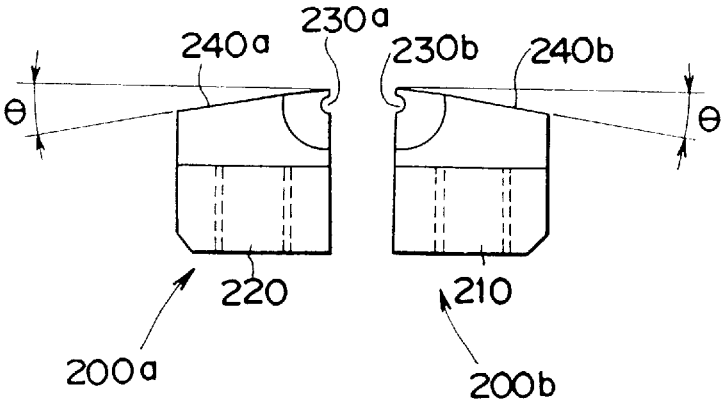
FIG. 10 is a detailed view of the distal end portion of one guide shown in FIG. 8.

FIG. 8 is a perspective exploded view of the guides of this embodiment. FIG. 9 is a perspective view showing a state wherein the respective guides shown in FIG. 8 are assembled together. FIG. 10 is a detailed view of the distal end portion of one guide shown in FIG. 8. Referring to FIGS. 8 to 10, the guide 200 is constituted by right and left guides 200*b* and 200*a* having shapes symmetric with each other. Groove portions 230*a* and 230*b* having semicircular sections are formed in the sections of the guides 200*a* and 200*b*, respectively, in the longitudinal direction, and positioning holes 220 and 210 are respectively formed at low portions thereof. The upper surfaces of the guides 200*a* and 200*b* form inclined surfaces 240*a* and 240*b* having predetermined inclination angles. When the right and left guides are mated, as shown in FIG. 9, the groove portions 230*a* and 230*b* respectively formed in the guides 200*a* and 200*b* form a wire insertion hole 230 having a circular section. As shown in FIG. 10, the inclined surfaces 240*a* and 240*b* formed on the upper surfaces of the respective guides 200*a* and 200*b* have an outwardly downward inclination of a predetermined angle, and this angle θ of inclination is set to almost 10°. More specifically, when the rotatable portion 47 shown in FIG. 5 is rotated to change the positions of the inclined surfaces 240*a* and 240*b* in the spring forming space, the inclined surfaces 240*a* and 240*b* serve as spring forming surfaces (to be described later). The guide 200 is made of a material, e.g., a sintered hard alloy, having a high wear resistance.

As described above, the guide 200 for feeding out the wire 2 is constituted by right and left two symmetrical members. Even if the wire is stuck in the insertion hole of the guide, the stuck wire can be easily removed. Even if the distal end portion of the guide is partially broken, the guide can be re-formed and arranged at a position further forward than before, so that it can be used again. The guide can be made small, and the cost can be remarkably suppressed when compared to the conventional quill.

Shape of Liner

The arrangement of the liner will be described.

Figure 11:
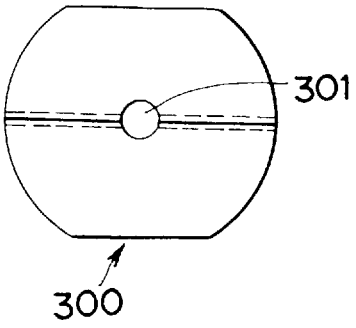
FIG. 11 is a sectional view of the liner of this embodiment.
Figure 12A:
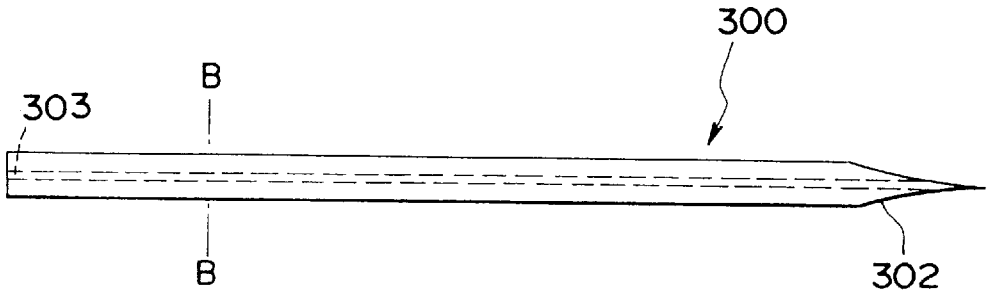
FIGS. 12A and 12B are plan and side views, respectively, of the liner shown in FIG. 11.
Figure 12B:
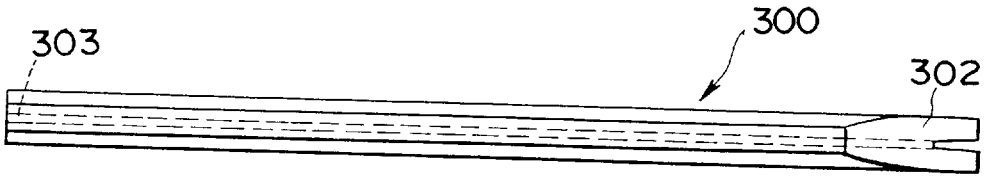

FIG. 11 is a sectional view of the liner of this embodiment, and FIGS. 12A and 12B are top and side views, respectively, of the liner shown in FIG. 11. Referring to FIGS. 11 and 12, the liner 300 serves as a convey path for receiving the wire 2, fed out from the feed rollers 7 and 8, and feeding it out to the guide 200. The liner 300 is a rod-type member, and an insertion hole 301 for inserting the wire 2 therein is formed in its central portion. As shown in FIG. 12A, one end portion 302 of the liner in the longitudinal direction is tapered toward its distal end. When the liner 300 is assembled in the base portion 41, described with reference to FIG. 5, to extend through it, the tapered one end portion 302 substantially coincides with the distal end portion 46 of the base portion 41, and its other end portion 303 projects from the cylindrical projecting portion 41*a* of the base portion 41 and extends through near the central portion of the disk member 45 at a small gap with respect to the guide 200. More specifically, the wire insertion hole 301 of the liner 300 and the wire insertion hole 230 of the guide 200 coincide with each other when the liner 300 is assembled in the rotary wire guide unit. The liner is also made of a material, e.g., a sintered hard alloy, having a high wear resistance, considering friction with the wire.

Block Arrangement of Control System of Spring Manufacturing Apparatus

The block arrangement of the control system of the spring manufacturing apparatus of this embodiment will be described.

Figure 13:
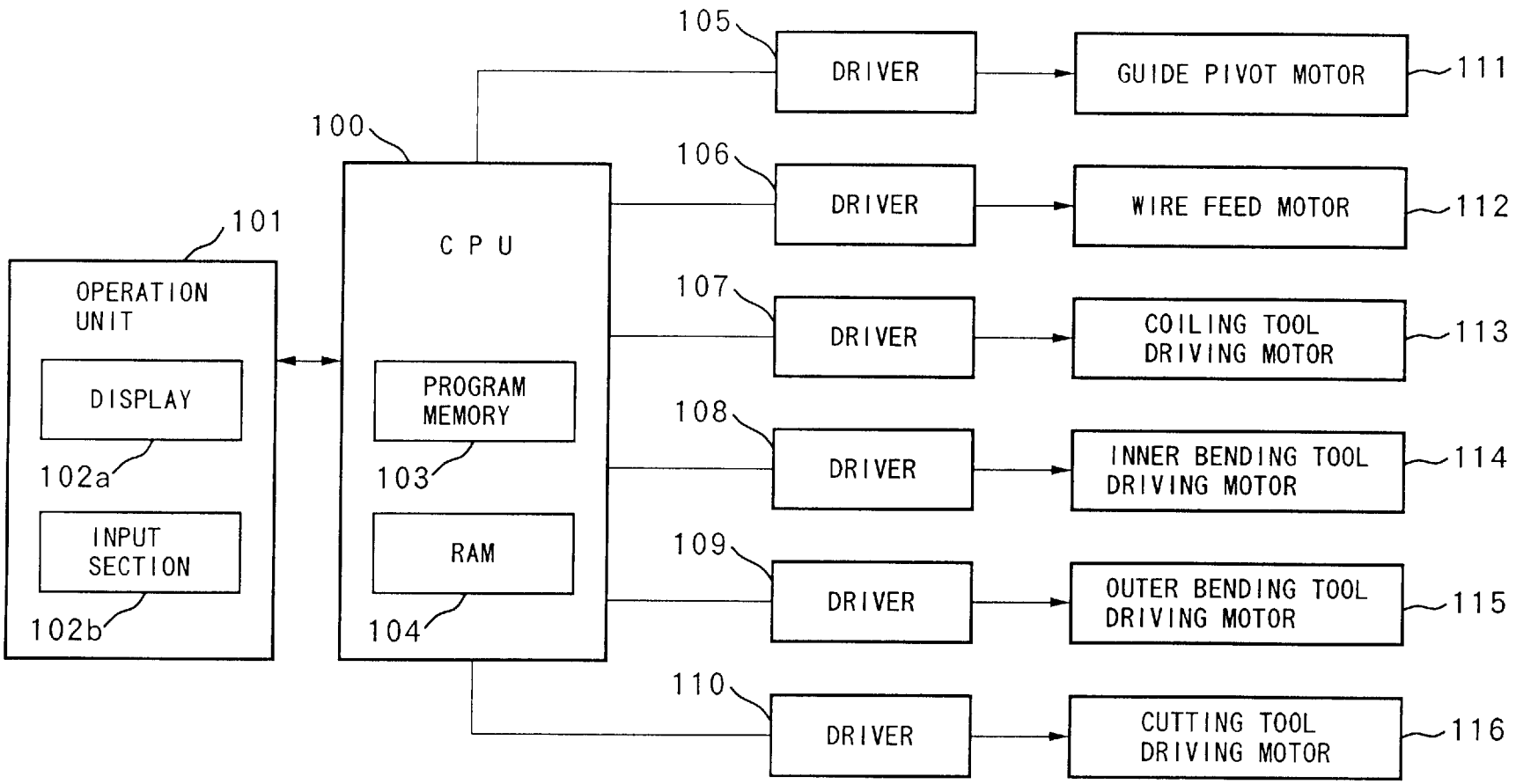
FIG. 13 is a block diagram of the control system of the spring manufacturing apparatus of this embodiment.

FIG. 13 is a block diagram of the control system of the spring manufacturing apparatus of this embodiment. Referring to FIG. 13, a central processor unit (CPU) 100 controls the entire apparatus. The operation unit 101 is used for setting various types of parameters for, e.g., moving the tools in spring manufacture, and for supplying commands for moving and stopping the tools. The operation unit 101 has the display 102*a* for displaying the operation content and the state of the apparatus, and the input section 102*b*. The CPU 100 has a 103 ROM for storing the operation sequence and a 104 RAM used for the work area. Reference numerals 105 to 110 denote drivers of the motors (servo motors) to be described later. A rotary wire guide rotating motor 111 rotates the guide at a predetermined timing. A wire feed motor 112 serves as the rotation driving source of the feed rollers 7 and 8. A coiling tool driving motor 113 vertically moves a coiling tool 31. Inner and outer bending tool driving motors 114 and 115 move bending tools 32 and 33 shown in FIG. 14. A cutting tool driving motor 116 moves a cutting tool 34. As shown in FIG. 13, all of these tools 31 to 34 are connected to the CPU 100 through the drivers 105 to 110 so that they are driven under the control of the CPU 100. In this embodiment, separate driving motors are provided to the coiling tool, the bending tools, and the cutting tool for the sake of descriptive convenience. However, the respective tools may be driven by one common motor at predetermined timings by using separate cams.

Principle of Manufacture of Spring

The principle of the manufacture of a spring will be described with reference to FIGS. 14 to 21. In the following description, the principle of the manufacture of a tension spring and a double-torsion spring as two typical springs will be described.

Manufacturing Steps of Tension Spring

Figure 14:
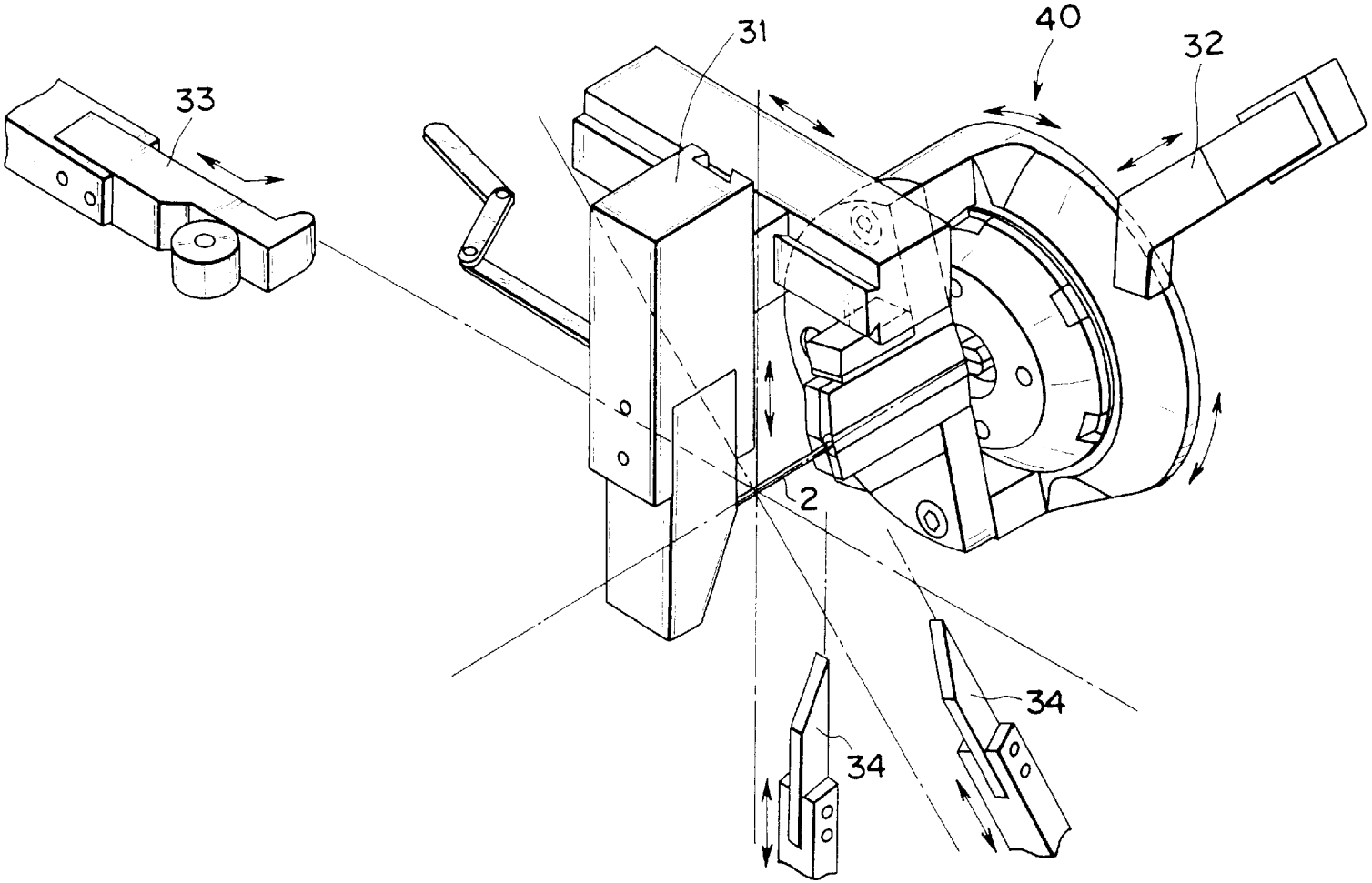
FIG. 14 is a view showing the arrangement of a portion including the spring manufacturing space of this embodiment.
Figure 15A:
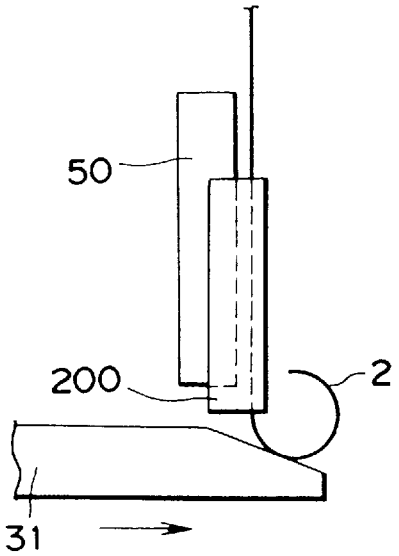
FIGS. 15A and 15B are views showing the manufacturing steps of a tension spring in a simplified manner.
Figure 15B:
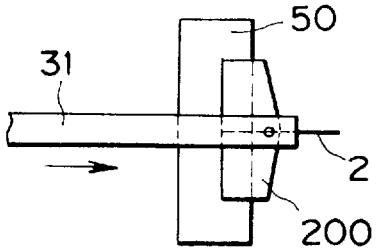
Figure 16A:
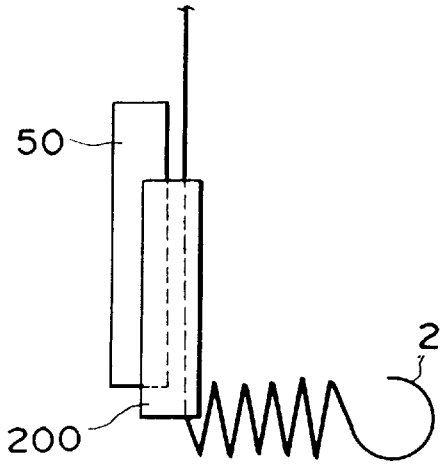
FIGS. 16A and 16B are views showing the manufacturing steps of the tension spring in a simplified manner.
Figure 16B:
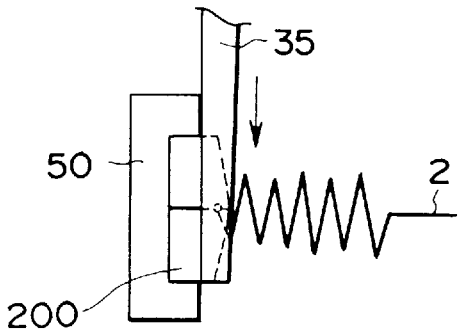
Figure 17A:
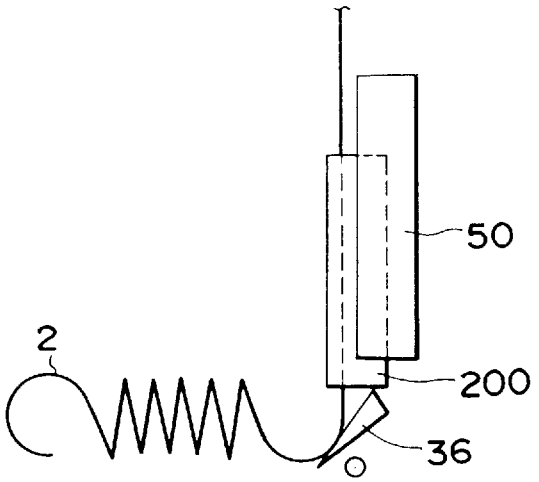
FIGS. 17A and 17B are views showing the manufacturing steps of the tension spring in a simplified manner.
Figure 17B:
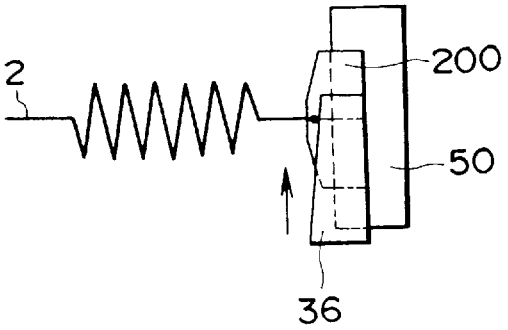

FIG. 14 is a view showing the arrangement of a portion including the spring manufacturing space of this embodiment, and FIGS. 15 to 17 show the manufacturing steps of a tension spring in a simplified manner. FIGS. 15A, 16A, and 17A show the spring manufacturing space from above, and FIGS. 15B, 16B, and 17B show the spring manufacturing space from the front. Referring to FIGS. 14 to 17, the wire 2 is supplied from a wire supply source (not shown) into a gap between the feed rollers 7 and 8, and is fed out from the distal end portion of the wire guide 200 through the liner incorporated in the rotary wire guide unit 40. The fed-out wire 2 is caused to abut against the coiling tool 31, thereby forming the first distal end portion of the spring, e.g., a hook portion (see FIGS. 15A and 15B). Thereafter, a predetermined tool is driven, thereby bending the base of the hook portion of the wire 2 at about 90°. A coiling tool 35 (shown FIG. 16B) is caused to abut against the wire 2, and the wire 2 is fed out further, so that a coil portion forms to be perpendicular to the inclined portion of the guide. When the coil length reaches a predetermined value, the feedout operation of the wire 2 is stopped (see FIGS. 16A and 16B). The distance between the distal end portion of the guide and the coiling tool determines the coil diameter of the spring. Thereafter, in order to form another hook portion as the second distal end portion, the guide 200 (the rotatable portion 47 shown in FIG. 5) is rotated through almost 180° to rotate the inclined surface of the guide 200 in a direction opposite to the former direction (refer to the positional relationship of the guide 200 shown in FIGS. 15 and 17). In this state, a bending tool 36 is slid to bend the wire 2 toward the inclined surface for a predetermined amount and curve it, thereby forming a hook portion. The wire 2 is then cut by using the cutting tool 34 (see FIG. 14), thereby forming a tension spring having hook portions at its two ends (see FIGS. 17A and 17B).

Manufacturing Steps of Double-Torsion Spring

The manufacturing steps of a double-torsion spring will be described.

Figure 18A:
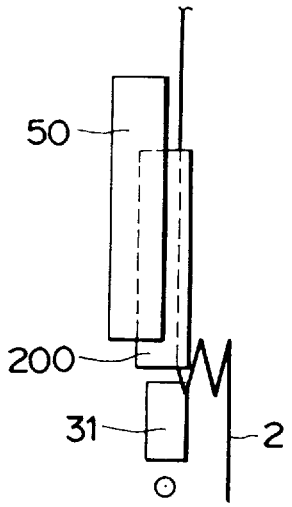
FIGS. 18A to 18C are views showing the manufacturing steps of the spring of a double-torsion spring in a simplified manner.
Figure 18B:
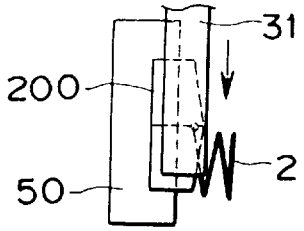
Figure 18C:
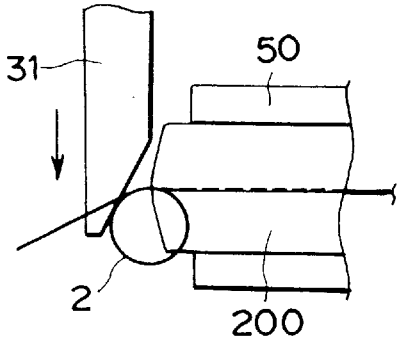
Figure 19A:
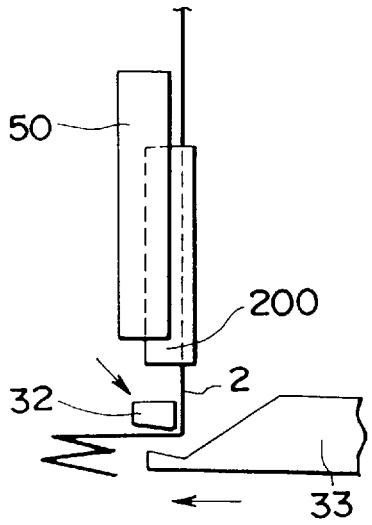
FIGS. 19A and 19B are views showing the manufacturing steps of the spring of the double-torsion spring in a simplified manner.
Figure 19B:
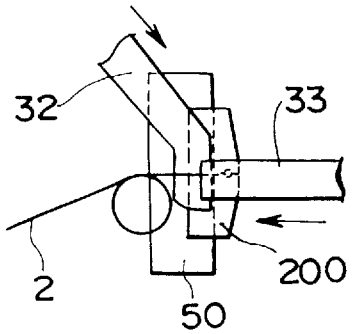
Figure 20A:
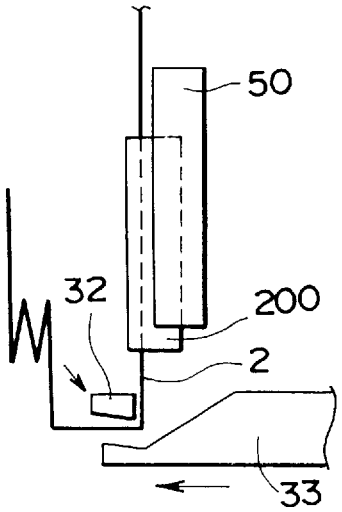
FIGS. 20A and 20B are views showing the manufacturing steps of the spring of the double-torsion spring in a simplified manner.
Figure 20B:
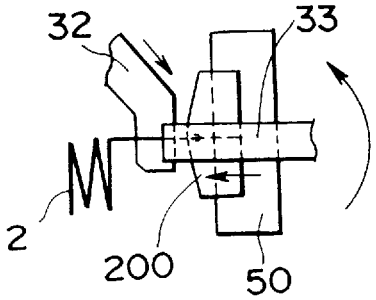
Figure 21A:
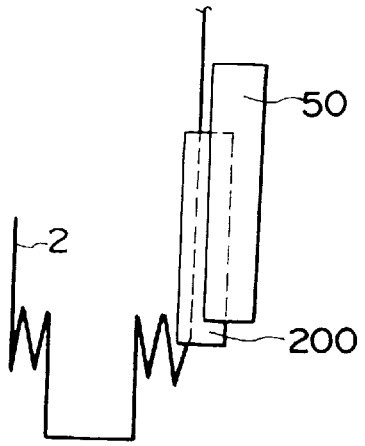
FIGS. 21A to 21C are views showing the manufacturing steps of the spring of the double-torsion spring in a simplified manner.
Figure 21B:
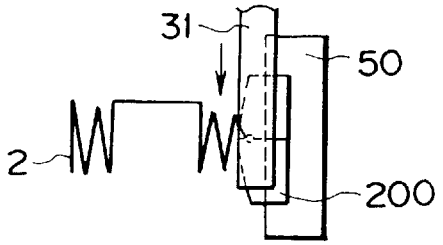
Figure 21C:
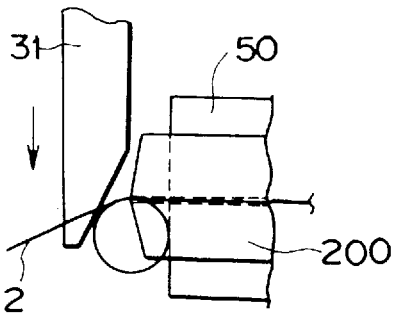

FIGS. 18 to 21 are views showing the manufacturing steps of the spring of a double-torsion spring in a simplified manner, in which FIGS. 18A, 19A, 20A, and 21A show the spring manufacturing space from above, FIGS. 18B, 19B, 20B, and 21B show the spring manufacturing space from the front, and FIGS. 18C and 21C show the spring manufacturing space from a side. Referring to FIG. 14 and FIGS. 18 to 21, the wire 2 is supplied from the wire supply source (not shown) into the gap between the feed rollers 7 and 8 (not shown), and is fed out from the distal end portion of the guide 200 through the liner incorporated in the rotary wire guide unit 40, in the same manner as the tension spring. The wire 2 is then fed out for a predetermined amount to form a linear portion as the first distal end portion, and is caused to abut against the coiling tool 31, thereby forming the first coil portion of the spring (see FIGS. 18A to 18C) . Thereafter, the coiling tool 31 is retracted, and the wire 2 is fed out for a predetermined amount, thereby forming a linear portion. The bending tools 32 and 33 are caused to abut against the wire 2, thereby bending the wire 2 for a predetermined amount. The bending tools 32 and 33 are retracted. In order to further bend the wire 2, the guide 200 (the rotatable portion 47 shown in FIG. 5) is rotated through almost 180° to rotate the inclined surface of the guide 200 in a direction opposite to the former direction (refer to the positional relationship of the guide 200 shown in FIGS. 19 and 20). After the guide 200 is rotated, the wire is fed out for a predetermined amount, and the bending tools 32 and 33 are caused to abut against the wire 2, thereby forming an intermediate engaging portion (see FIGS. 20A and 20B). Thereafter, the coiling tool 31 is caused to abut against the wire 2 again, and the wire 2 is fed out further, thereby forming the second coil portion to be perpendicular to the inclined surface of the guide. When the coil length reaches a predetermined value, the feedout operation of the wire 2 is stopped (see FIGS. 21A to 21C). The distance between the distal end portion of the guide and the coiling tool determines the coil diameter of the spring. Thereafter, in order to form another linear portion as the second distal end portion, the wire 2 is fed out for a predetermined distance, and is cut by using the cutting tool 34 (see FIG. 14), thereby forming a double-torsion spring having two coil portions (see FIGS. 21A to 21C).

Cutting Principle of Spring

When one spring is manufactured in accordance with the above process, this spring is cut. The principle of this cutting process will be described.

Figure 22:
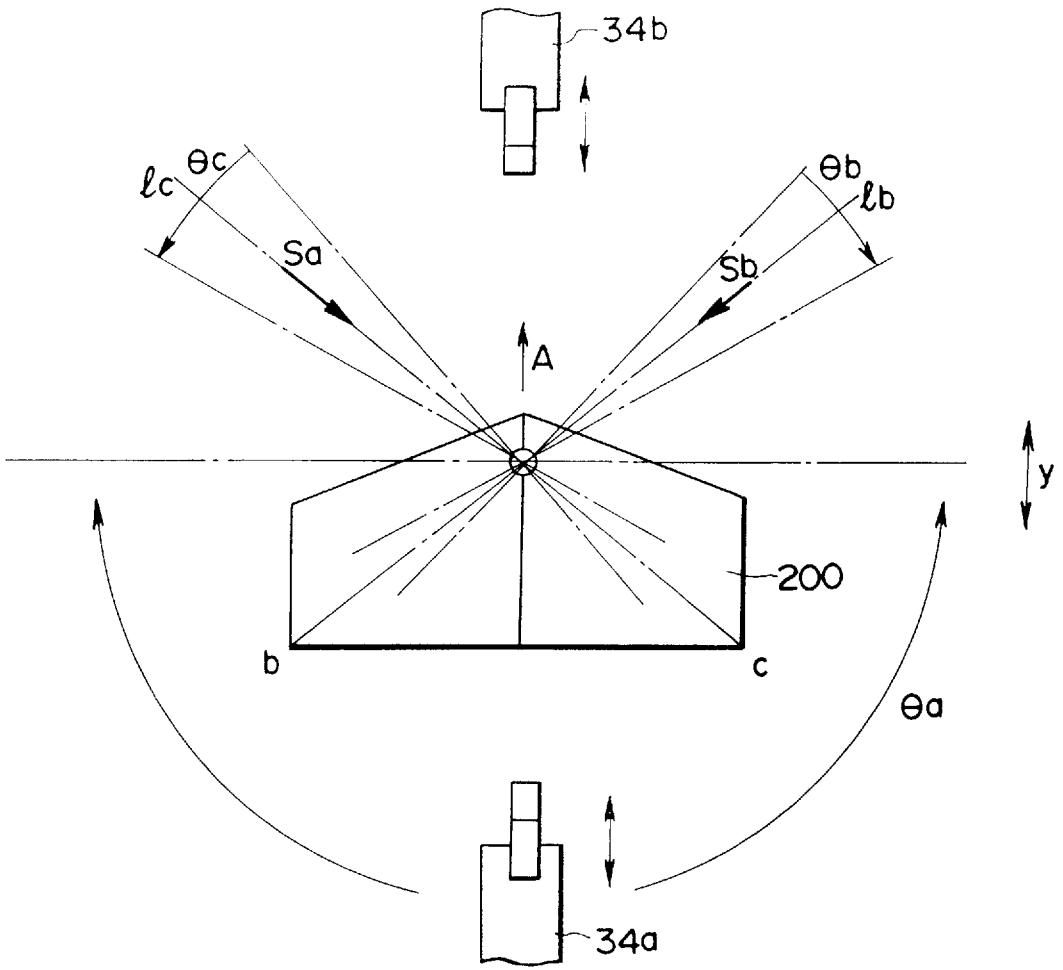
FIG. 22 is a view showing the principle of a wire cutting process of this embodiment.

FIG. 22 is a view for explaining the principle of the wire cutting process. Referring to FIG. 22, assume that the cutting tool 34 is located at a position 34*a*. In this case, the wire projecting from the wire feedout hole of the guide 200 receives a stress in a direction A. Then, although the guide 200 supports the wire feedout hole, it receives the wire cutting force with its extremely thin portion. In a worst case, a portion of the guide 200 near the feedout hole for the wire 2 is undesirably partially broken. Therefore, the cutting tool 34 should not be moved from within an angle of θa toward the wire, or be arranged within the angle of θa.

When the cutting tool 34 is located at a position 34*b* of FIG. 22, although the cutting effect is higher than in a case wherein the cutting tool 34 is located at the position 34*a*, this is not an optimum state. This is because the cutting force acts to enter a section, where the two left guides 200*a* and 200*b* abut against each other, in a direction y shown in FIG. 22.

Therefore, in this embodiment, when the wire 2 is to be cut, the entering direction of the cutting tool is set within a predetermined range of θb or θc shown in FIG. 22. Note that, when the wire 2 is cut, the strength of the guide 200 is considered to be maximum in the direction of arrows Sb and Sa on line lb and lc which pass trough either point b or c and the hole, thus the ranges of θb and θc are determined within an angle, 15°~30°, for instance, including the lines lb and lc, but not including the range of θa, in which the guide 200 can maintain sufficient strength. In this manner, although the guide is small, it can sufficiently endure the cutting force. The entering direction of the cutting tool is determined in advance. The guide is rotated when the cutting timing arrives, thereby setting the cutting tool within either the range of θb or θc shown in FIG. 22. The ranges of θb and θc change in accordance with the size and shape of the guide, the diameter of the wire, and the like.

Spring Manufacturing Sequence

The spring manufacturing sequence of this embodiment having the arrangement shown in the drawings will be described in accordance with the flow charts of FIGS. 23 to 27. In the following description, for the sake of descriptive simplicity, the manufacturing sequence of the tension spring and the double-torsion spring described with reference to FIGS. 15 to 22 will be described.

Manufacturing Sequence of Tension Spring

Figure 23:
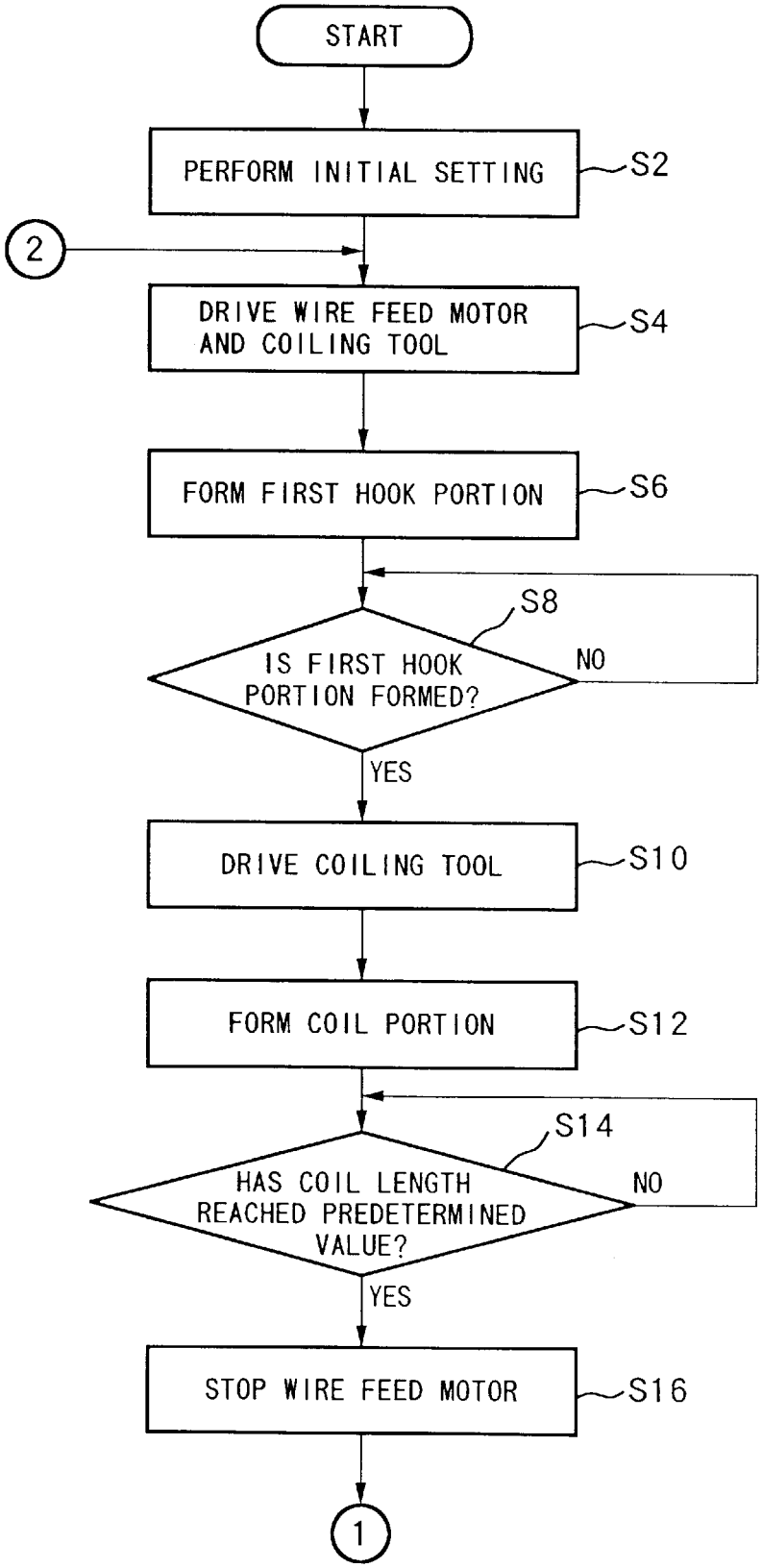
FIG. 23 a flow chart for explaining the manufacturing sequence of a tension spring of this embodiment.
Figure 24:
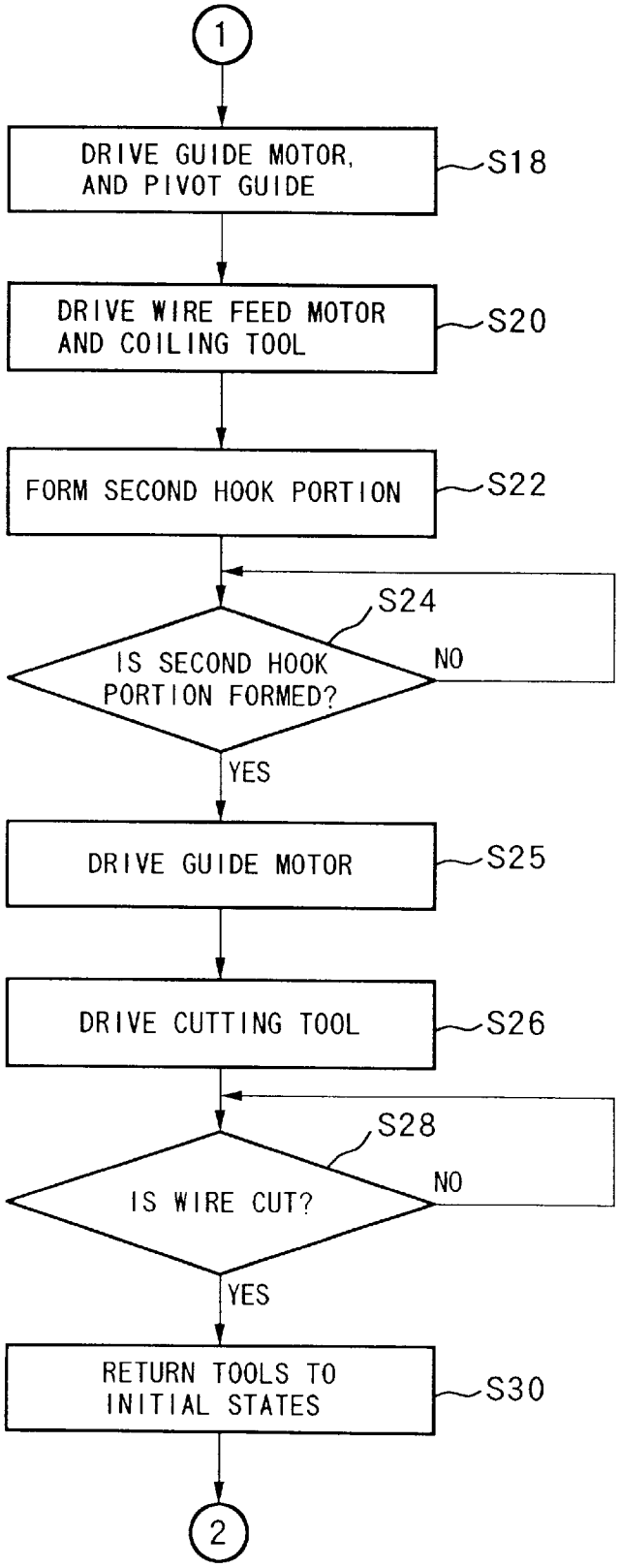
FIG. 24 is a flow chart for explaining the manufacturing sequence of the tension spring of this embodiment.

The manufacturing sequence of a tension spring will be described with reference to the flow charts of FIGS. 23 and 24.

First, in initial setting of step S2, various types of parameters, e.g., the thickness (outer diameter) of the wire and the free length of the spring, are set based on the shape of the spring to be formed.

When the flow advances to step S4, the wire feed motor 112 and the coiling tool driving motor 113 are driven based on given parameters. In step S6, the wire is curved to form the first hook portion of the spring.

In step S8, whether or not the first hook portion is formed is determined. This determination can be made in accordance with whether or not the wire has been fed out for a distance corresponding to a given length of a spring hook formation portion. The wire feed motor 112 and the coiling tool driving motor 113 are continuously operated in accordance with the program until it is determined that a hook is formed.

If it is determined in step S8 that the first hook portion is formed (YES in step S8), the flow advances to step S10 to drive the coiling tool driving motor 113. In step S12, a coil portion is formed. Then, in step S14, whether or not the coil length has reached a predetermined value is determined. This determination can be made by providing a laser sensor or the like.

If it is determined in step S14 that the coil length has reached a predetermined value (YES in step S14), the flow advances to step S16 to temporarily stop the wire feed motor 112. In step S18, the guide rotating motor 111 is driven to rotate the guide to a predetermined position. In steps S20 and S22, the wire feed motor 112 and the coiling tool driving motor 113 are driven to curve the wire in order to form the second hook portion of the spring. In step S24, whether or not the second hook portion is formed is determined. This determination can be made in accordance with whether or not the wire has been fed out for a distance corresponding to a given length of a hook formation portion of the spring, in the same manner as in step S8.

If it is determined in step S24 that the second hook port ion is formed (YES in step S24), the guide rotating motor 111 is driven to rotate the guide to a predetermined cutting position in step S25. The flow advances to step S26 to drive the cutting tool driving motor 116, thereby cutting the wire 2. In step S28, whether or not the wire 2 has been cut is determined. This determination can also be made by providing a laser sensor or the like.

If it is determine d in step S28 that the wire is cut (YES in step S28), the flow advances to step S30 to return the respective tools to the preset initial positions. Then, the flow returns to step S4.

One tension spring is formed in accordance with the above sequence.

Manufacturing Sequence of Double-Torsion Spring

Figure 25:
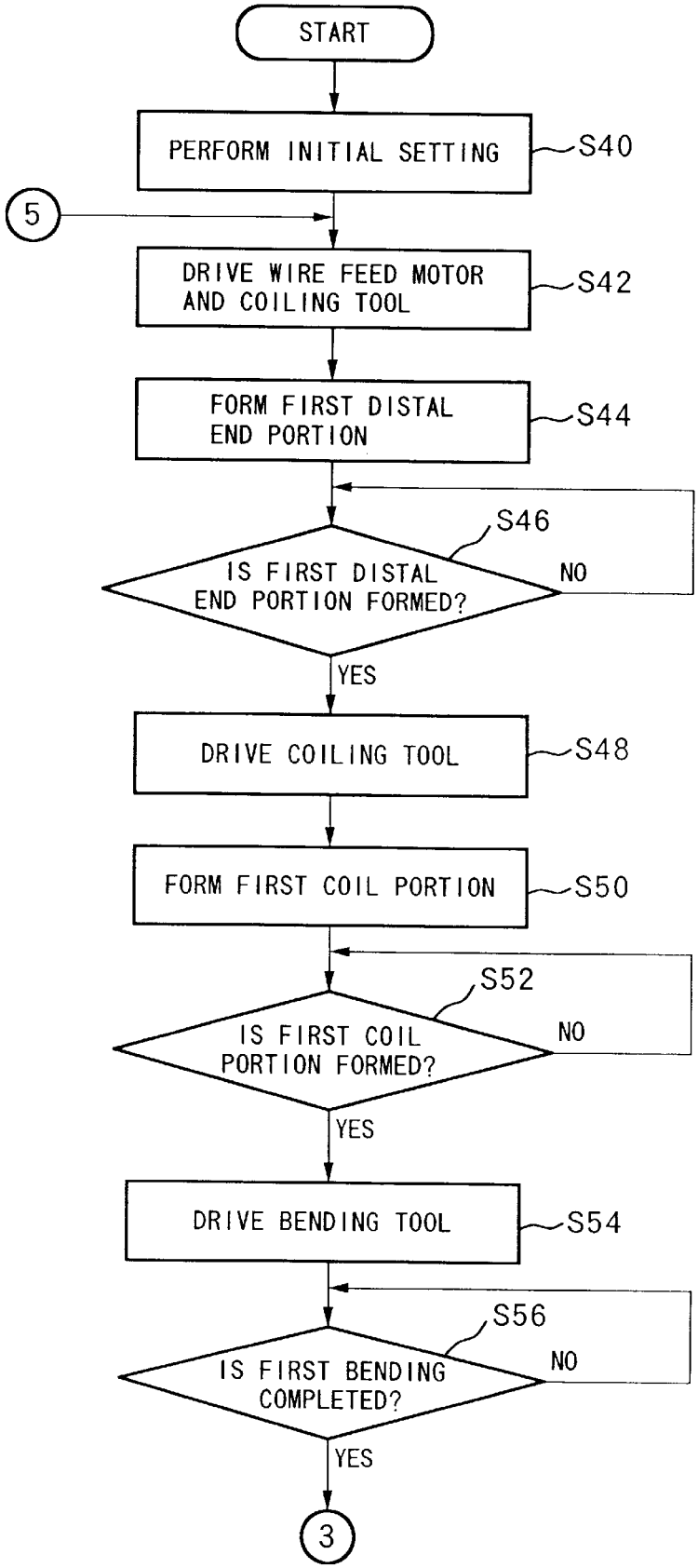
FIG. 25 is a flow chart for explaining the manufacturing sequence of a double-torsion spring of this embodiment.
Figure 26:
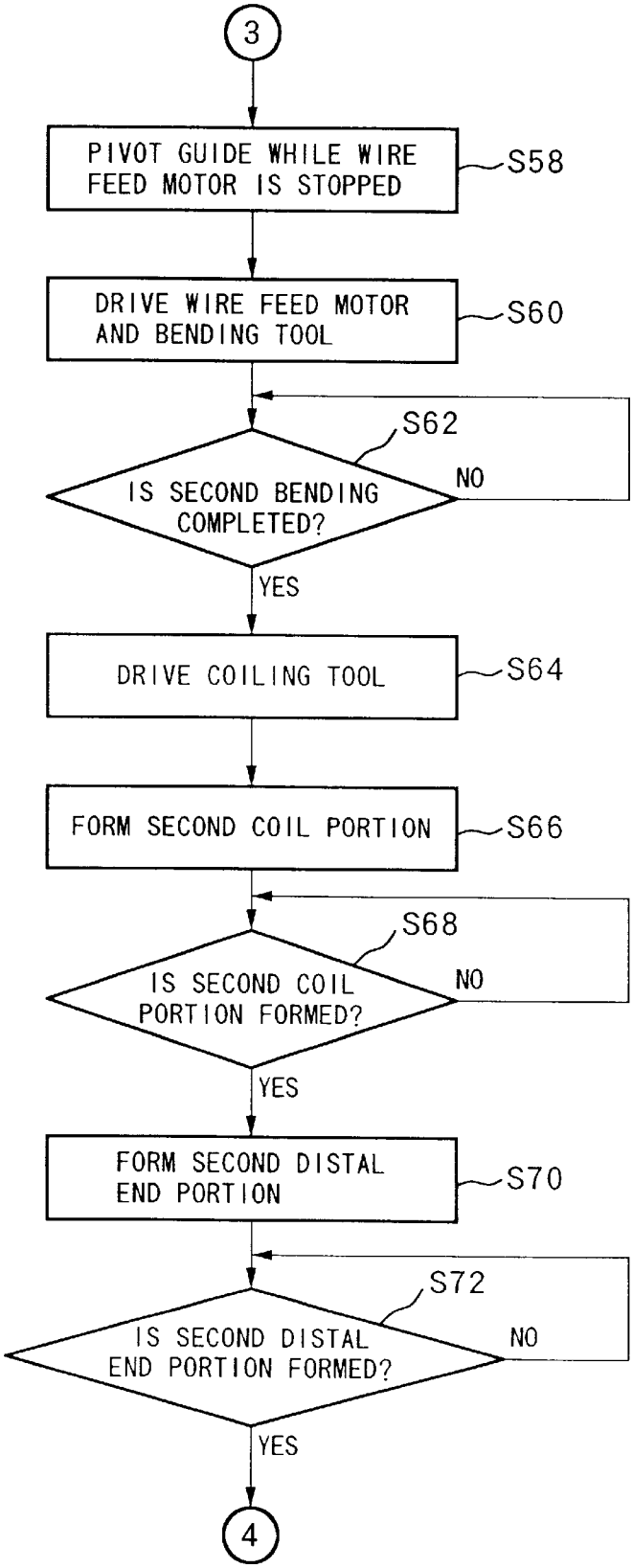
FIG. 26 is a flow chart for explaining the manufacturing sequence of the double-torsion spring of this embodiment.
Figure 27:
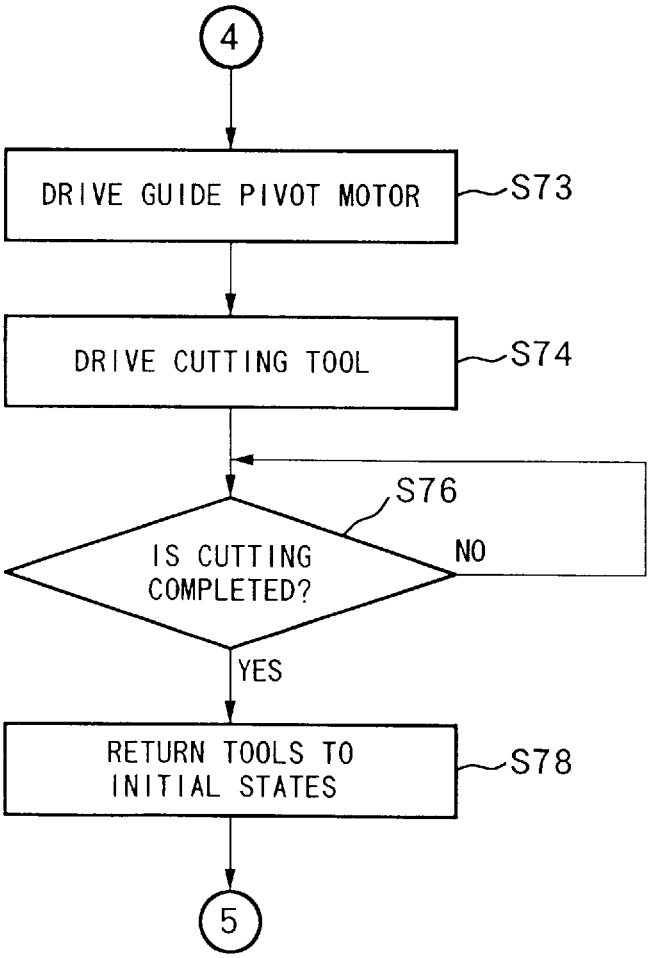
FIG. 27 is a flow chart for explaining the manufacturing sequence of the double-torsion spring of this embodiment.

The manufacturing sequence of a double-torsion spring will be described with reference to the flow charts of FIGS. 25 to 27.

First, in initial setting of step S40, various types of parameters, e.g., the thickness (outer diameter) of the wire and the free length of the spring, are set based on the shape of the spring to be formed.

When the flow advances to step S42, the wire feed motor 112 and the coiling tool driving motor 113 are driven based on given parameters. In step S44, the wire is curved to form the first distal end portion of the spring.

In step S46, whether or not the first distal end portion is formed is determined. This determination can be made in accordance with whether or not the wire has been fed out for a distance corresponding to a given length of a distal end formation portion of the spring. The wire feed motor 112 and the coiling tool driving motor 113 are continuously operated in accordance with the program until it is determined that a distal end portion is formed.

If it is determined in step S46 that the first distal end portion is formed (YES in step S46), the flow advances to step S48 to drive the coiling tool driving motor 113. In step S50, the first coil portion is formed. Then, in step S52, whether or not the coil length has reached a predetermined value is determined. This determination can be made by providing a laser sensor or the like.

If it is determined in step S52 that the coil length has reached a predetermined value (YES in step S52), the flow advances to step S54 to temporarily stop the wire feed motor 112. The bending tool driving motors 114 and 115 are driven to bend the wire at a predetermined angle. In step S56, whether or not the first bending operation has been completed is determined. This determination can be made by providing a laser sensor or the like.

If it is determined in step S56 that the first bending operation is completed (YES in step S56), the flow advances to step S58. While the wire feed motor 112 is stopped, the guide rotating motor 111 is driven to rotate the guide to a predetermined position. In step S60, the wire feed motor 112 and the bending tool driving motors 114 and 115 are driven to perform the second bending operation. In step S62, whether or not the second bending operation has been completed is determined. This determination is identical to that of step S56.

If it is determined in step S62 that the second bending operation is completed (YES in step S62), the flow advances to step S64 to drive the wire feed motor 112 and the coiling tool driving motor 113. In step S66, the second coil portion is formed. Then, in step S68, whether or not the coil length has reached a predetermined value is determined. This determination can be made by providing a laser sensor or the like.

If it is determined in step S68 that the coil length has reached a predetermined value (YES in step S68), the flow advances to step S70 to drive the wire feed motor 112 and the coiling tool driving motor 113 to curve the wire, thereby forming the second distal end portion of the spring.

In step S72, whether or not the second distal end portion is formed is determined. This determination can be made in accordance with whether or not the wire has been fed out for a distance corresponding to a given length of a distal end formation portion of the spring. The wire feed motor 112 and the coiling tool driving motor 113 are continuously operated in accordance with the program until it is determined that a distal end portion is formed.

If it is determined in step S72 that the second distal end portion is formed (YES in step S72), the guide rotating motor 111 is driven to rotate the guide to a predetermined cutting position in step S73. Thereafter, the flow advances to step S74 to drive the cutting tool driving motor 116, thereby cutting the wire 2. In step S76, whether or not the wire 2 has been cut is determined. This determination can also be made by providing a laser sensor or the like.

If it is determined in step S76 that the wire is cut (YES in step S76), the flow advances to step S78 to return the respective tools to the preset initial positions. Then, the flow returns to step S42.

One double-torsion spring is formed in accordance with the above sequence.

Comparison with Prior Art Technique

The principle of the manufacture of a spring in accordance with the prior art technique and the principle of the manufacture of a spring according to this embodiment will be compared with reference to FIGS. 28 to 34. In the following description, the principle of the manufacture of a tension spring and a double-torsion spring as two typical springs will be described.

Manufacturing Steps of Tension Spring of Prior Art Technique

Figure 28A:
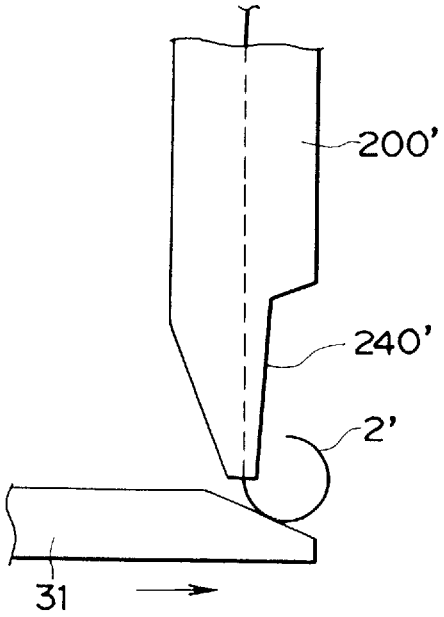
FIG.28A PRIOR ART
FIGS. 28A and 28B are views showing the manufacturing steps of a tension spring of the prior art technique in a simplified manner.
Figure 28B:
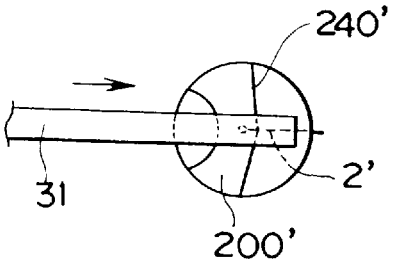
FIG.28B PRIOR ART
Figure 29A:
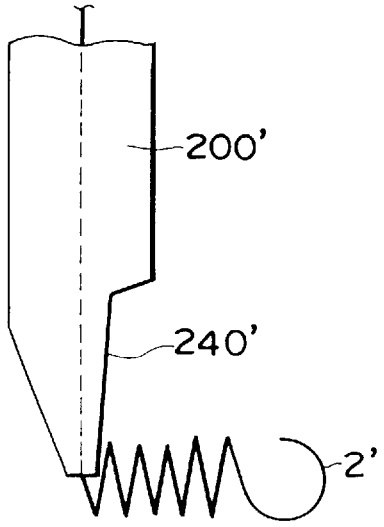
FIG.29A PRIOR ART
FIGS. 29A and 29B are views showing the manufacturing steps of the tension spring of the prior art technique in a simplified manner.
Figure 29B:
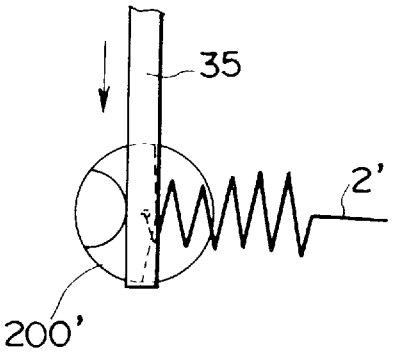
FIG.29B PRIOR ART
Figure 30A:
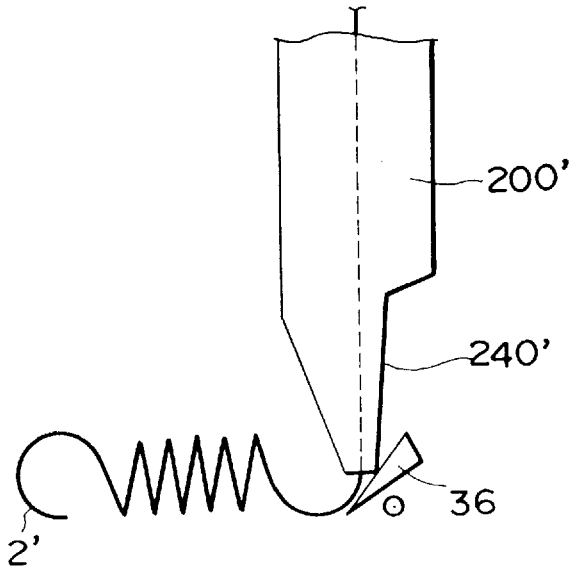
FIG.30A PRIOR ART
FIGS. 30A and 30B are views showing the manufacturing steps of the tension spring of the prior art technique in simplified manner.
Figure 30B:
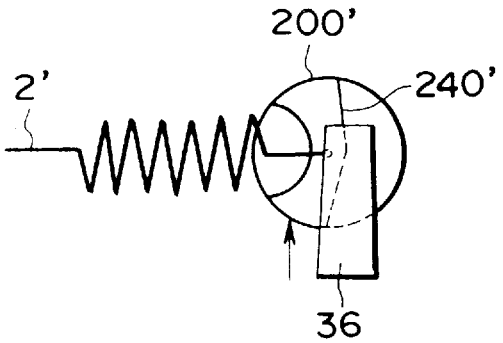
FIG.30B PRIOR ART

FIGS. 28 to 30 show the manufacturing steps of a tension spring in a simplified manner. FIGS. 28A, 29A, and 30A show the conventional spring manufacturing space from above, and FIGS. 28B, 29B, and 30B show the conventional spring manufacturing space from the front. Referring to FIGS. 28 to 30, a wire 2' is supplied from a wire supply source (not shown) toward feed rollers (not shown), and is fed out through the front end portion of a quill 200'. The quill 200' is made specially for a tension spring, and is obtained by partially grinding the front end portion of a rod-type member having a circular section. The ground surface is used as a coil forming surface 240'. The fed-out wire 2' is caused to abut against a coiling tool 31, thereby forming the first distal end portion of the spring, e.g., a hook portion (see FIGS. 28A and 28B). Another coiling tool 35 is caused to abut against the wire 2' from a direction perpendicular to the coiling tool 31, and the wire 2' is further fed out, so that a coil portion forms to be perpendicular to the coil forming surface 240 ' of the quill 200'. When the coil length reaches a predetermined value, the feedout operation of the wire 2 is stopped (see FIGS. 29A and 29B). Thereafter, in order to form another hook portion as the second distal end portion, a coiling tool 36 is urged against the wire 2' such that the coil portion is directed opposite to the coil forming surface 240' of the quill 200'. The wire 2' is bent by the coiling tool 36 for a predetermined amount and curved, thereby forming a hook portion. The wire 2' is cut by using a cutting tool 34, thereby forming a tension spring having hook portions at its two ends (see FIGS. 30A and 30B).

Manufacturing Steps of Double-Torsion Spring

The manufacturing steps of a double-torsion spring in accordance with the prior art technique will be described.

Figure 31A:
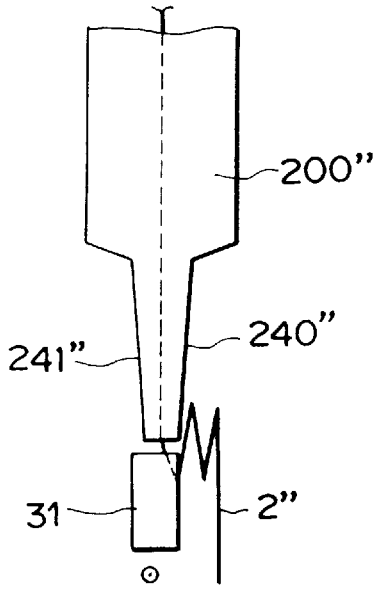
FIG.31A PRIOR ART
FIGS. 31A to 31C are views showing the manufacturing steps of a double-torsion spring of the prior art technique in a simplified manner.
Figure 31B:
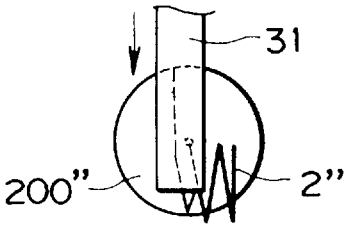
FIG.31B PRIOR ART
Figure 31C:
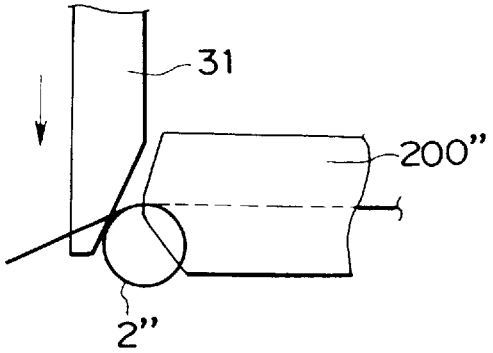
FIG.31C PRIOR ART
Figure 32A:
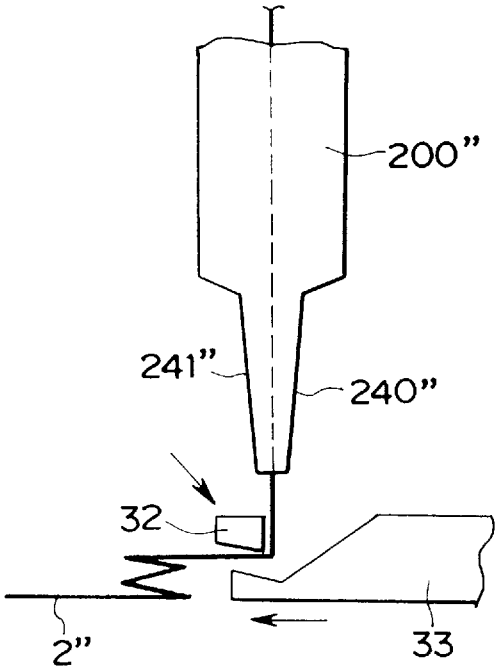
FIG.32A PRIOR ART
FIGS. 32A and 32B are views showing the manufacturing steps of the double-torsion spring of the prior art technique in a simplified manner.
Figure 32B:
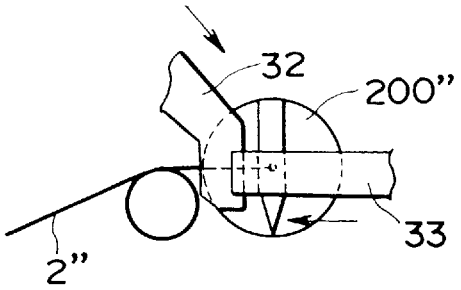
FIG.32B PRIOR ART
Figure 33A:
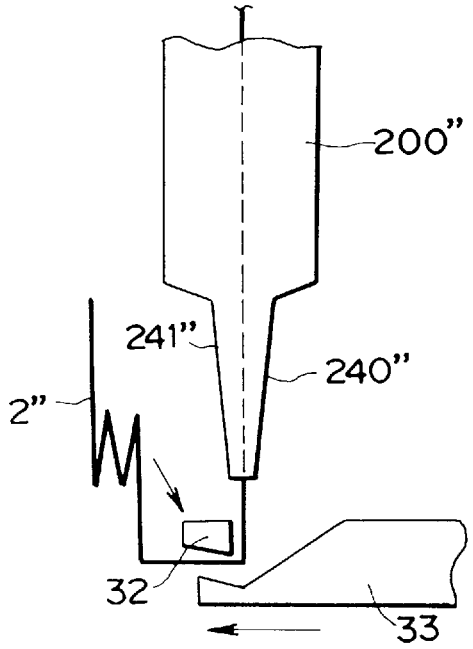
FIG.33A PRIOR ART
FIGS. 33A and 33B are views showing the manufacturing steps of the double-torsion spring of the prior art technique in a simplified manner.
Figure 33B:
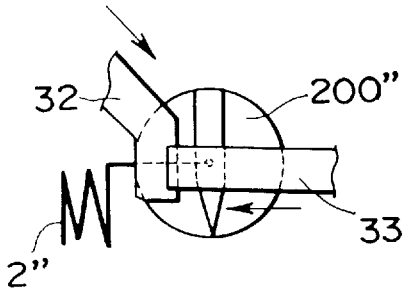
FIG.33B PRIOR ART
Figure 34A:
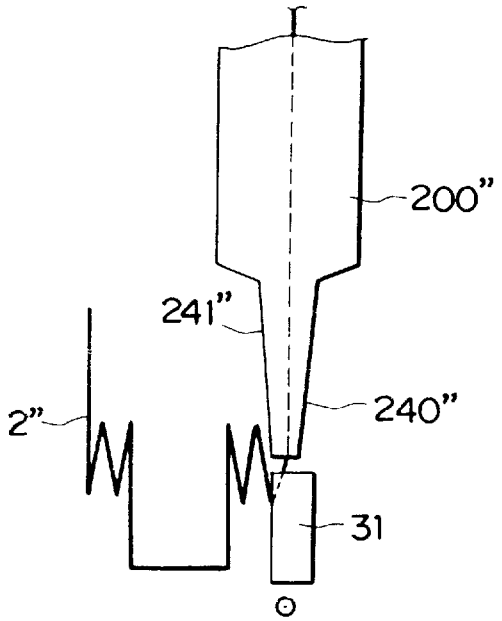
FIG.34A PRIOR ART
FIGS. 34A to 34C are views showing the manufacturing steps of the double-torsion spring of the prior art technique in a simplified manner.
Figure 34B:
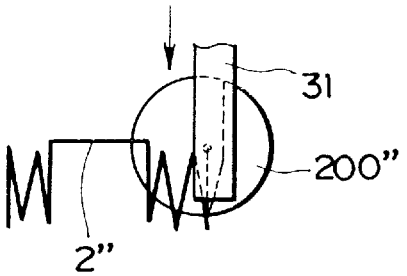
FIG.34B PRIOR ART
Figure 34C:
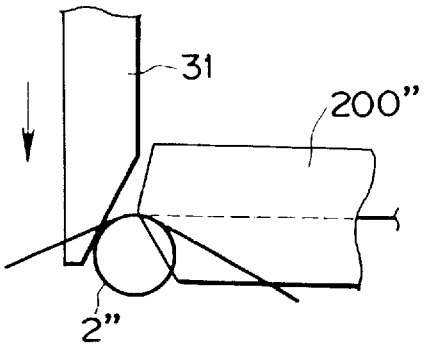
FIG.34C PRIOR ART

FIGS. 31 to 34 are views showing the manufacturing steps of the spring of a double-torsion spring in a simplified manner, in which FIGS. 31A, 32A, 33A, and 34A show the conventional spring manufacturing space from above, FIGS. 31B, 32B, 33B, and 34B show the conventional spring manufacturing space from the front, and FIGS. 31C and 34C show the conventional spring manufacturing space from a side. Referring to FIG. 31 to 34, a wire 2" is supplied from a wire supply source (not shown) from feed rollers (not shown), and is fed out through the front end portion of a quill 200", in the same manner as the tension spring. The quill 200 " is made specially for a double-torsion spring. The quill 200" has a coil forming surface corresponding to the coil forming surface 240' of the quill 200' on its lower surface, so that its two surfaces can be used as coil forming surfaces 240" and 241". The wire 2" is then fed out for a predetermined amount to form a linear portion as the first distal end portion, and is caused to abut against the coiling tool 31, thereby forming the first coil portion of the spring by using one coil forming surface 240 ", (see FIGS. 31A to 31C). Thereafter, the coiling tool 31 is retracted, and the wire 2" is fed out for a predetermined amount, thereby forming a linear portion. The bending tools 32 and 33 are caused to abut against the wire 2", thereby bending the wire 2" for a predetermined amount (see FIGS. 32A and 32B). In order to further bend the wire 2", the wire 2" is fed out for a predetermined amount, and the bending tools 32 and 33 are abutted against the wire 2", thereby forming an intermediate engaging portion (see FIGS. 33A and 33B). Thereafter, the coiling tool 31 is caused to abut against the wire 2" again, and the wire 2" is further fed out, thereby forming the second coil portion to be perpendicular to the other coil forming surface 241" of the quill 200". When the coil length reaches a predetermined value, the feedout operation of the wire 2" is stopped. Thereafter, in order to form another linear portion as the second distal end portion, the wire 2" is fed out for a predetermined distance, and is cut by using the cutting tool 34, thereby forming a double-torsion spring having two coil portions (see FIG. 34).

As described above, the manufacturing method of the prior art technique used quills having different front end shapes in accordance with desired spring shapes. In this embodiment, springs having different shapes can be manufactured only by rotating the same guide.

The pitch of the coil portion of the spring can be freely set only by setting the guide at a predetermined angular position.

As has been described above, according to this embodiment, the size of the wire guide can be decreased, and the torsion stress on the wire caused by rotation of the guide can be decreased.

Even when many types of springs are to be manufactured, the guide need not be exchanged.

The conventional cumbersome process of forming the front end of a quill in accordance with the shape of a desired spring, can be omitted only by making the wire feedout guide rotatable, thereby changing the spring forming space. The cost for stocking quills having various shapes can be decreased, and one quill can be used in common for formation of springs having any shapes.

When the wire is to be cut, the wire is cut obliquely downwardly from the wire feedout hole of the guide toward a portion of the guide having a high strength. Thus, the service life of the guide can be prolonged.

The present invention can be similarly applied to any other embodiments as its changes and modifications without departing from the spirit and scope of the invention. For example, in this embodiment, the guide is made of a material, e.g., a sintered hard alloy, having a high wear resistance. However, a part of the guide may be made of a sintered hard alloy, and the other portion of the guide may be made by using a different material, as far as the strength of the guide can be maintained.

The present invention is not limited to the above embodiment and various changes and modifications can be made within the spirit and scope of the present invention. Therefore, to apprise the public of the scope of the present invention the following claims are made.

What is claimed is:

1. A spring manufacturing apparatus for forming a spring from a wire, the apparatus comprising:

a wire guide wherein the wire is fed from an end of the wire guide, and forcibly bent or coiled with the use of tools which are pointed against the wire and are arranged slidably in a radial pattern toward a spring forming space near the end of the wire guide, said wire guide having a wire feedout hole for feeding the wire to the spring forming space, said wire guide being supported rotatably by a rotating means and having first and second wire guide block halves, that are separable along the wire feedout hole and symmetric with each other; each half having a first inclined surface to form an inclined angle of a coil where the wire lays against while coil forming; the first inclined surface extending to an entire length of the wire guide; and a separation surface of each half being formed with a groove, the grooves of the first and second wire guide block halves forming said wire feedout hole, when combined;

a plurality of said tools arranged slidably in a radial pattern toward a spring forming space near said front end of the wire guide, to point against the wire for coiling the wire;

said rotating means for supporting said wire guide and rotating said wire guide about said wire feedout hole;

first driving means for transmitting a driving force to said rotating means;

second driving means for sliding said coiling tools; and control means for controlling said first and second driving means, and for determining an orientation of said first inclined surface in accordance with a slide direction of the coiling tool toward the spring forming space so that a desired coil shape of the spring is formed by the first inclined surface of said wire guide and the coiling tool.

2. The apparatus according to claim 1, wherein said wire guide consists of a sintered hard alloy.

3. The apparatus according to claim 1, wherein said second driving means comprises a plurality of cams, for forming said spring forming space, cams of said plurality of cams being rotatably interlocked with tools of said plurality of tools, for sliding the tools at said various times.

4. The apparatus according to claim 1, wherein said each half has second inclined surface which is formed on a front end of said first and second wire guide block halves in accordance with a front end shape of the coiling tool so that the front end of said wire guide does not interfere with the coiling tool sliding toward the spring forming space;

the second inclined surface is symmetric with each other when combined and forms a cone locus when the wire guide is rotated about the wire feedout hole.

5. A wire guide supported rotatably by spring manufacturing apparatus, for feeding out a wire, to form a spring, from a front end of said wire guide, and to cause the wire to point against tools radially arranged around said wire guide in order to forcibly bend or curve the wire to form a coil, wherein said wire guide has first and second wire guide block halves, that are separable along the wire feedout hole and symmetric with each other; each half has a first inclined surface to form an inclined angle of a coil where the wire lays against while coil forming; the first inclined surface extends to an entire length of the wire guide; and a separation surface of each half being formed with a groove, the grooves of the first and second wire guide block halves form the wire feedout hole when combined.

6. The apparatus according to claim 5, wherein said each half has second inclined surface which is formed on a front end of said first and second wire guide block halves in accordance with a front end shape of the coiling tool so that the front end of said wire guide does not interfere with the coiling tool sliding toward the spring forming space;

the second inclined surface is symmetric with each other when combined and forms a cone locus when the wire guide is rotated about the wire feedout hole.

* * * * *